US010046945B2

(12) United States Patent
Ino et al.

(10) Patent No.: US 10,046,945 B2
(45) Date of Patent: Aug. 14, 2018

(54) IMAGE FORMING SYSTEM AND IMAGE FORMING APPARATUS

(71) Applicant: CANON KABUSHIKI KAISHA, Tokyo (JP)

(72) Inventors: Kazushi Ino, Suntou-gun (JP); Atsushi Ogata, Mishima (JP); Hiroki Kato, Gotemba (JP); Koji Kawamura, Yokohama (JP); Motohiro Furusawa, Shizuoka (JP); Ichiro Yasumaru, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/480,755

(22) Filed: Apr. 6, 2017

(65) Prior Publication Data

US 2017/0305713 A1 Oct. 26, 2017

(30) Foreign Application Priority Data

Apr. 21, 2016 (JP) ..... 2016-085426

(51) Int. Cl.
*B65H 85/00* (2006.01)
*G03G 15/00* (2006.01)

(52) U.S. Cl.
CPC ..... *B65H 85/00* (2013.01); *G03G 15/6529* (2013.01); *B65H 2301/3331* (2013.01); *B65H 2801/06* (2013.01); *G03G 2215/00438* (2013.01); *G03G 2215/00928* (2013.01)

(58) Field of Classification Search
CPC .. B65H 29/60; B65H 85/00; B65H 2301/332; B65H 2301/331; G03G 15/234; G03G 15/6579; G03G 2215/00438; G03G 2215/0043; G03G 2215/00928
See application file for complete search history.

(56) References Cited

U.S. PATENT DOCUMENTS

| | | | |
|---|---|---|---|
| 6,318,718 | B1 | 11/2001 | Ogata et al. |
| 6,325,371 | B1 | 12/2001 | Araki et al. |
| 6,804,473 | B2 | 10/2004 | Nakamura et al. |
| 6,826,374 | B2 | 11/2004 | Kato et al. |
| 6,997,449 | B2 | 2/2006 | Obuchi et al. |
| 7,050,751 | B2 | 5/2006 | Watanabe et al. |
| 8,720,886 | B2 | 5/2014 | Kuroda et al. |
| 8,870,182 | B2 | 10/2014 | Ogata et al. |
| 9,071,712 | B2 | 6/2015 | Ino et al. |
| 9,071,713 | B2 | 6/2015 | Ogata et al. |
| 9,137,403 | B2 | 9/2015 | Ogata et al. |

(Continued)

FOREIGN PATENT DOCUMENTS

JP 2006-232467 A 9/2006

*Primary Examiner* — Michael C McCullough
(74) *Attorney, Agent, or Firm* — Fitzpatrick, Cella, Harper & Scinto

(57) ABSTRACT

An image forming system includes an image forming apparatus, an image reading apparatus, and a connecting conveyance path that branches from a second main conveyance path of the image reading apparatus and joins a first sub conveyance path of the image forming apparatus, and is configured to convey an original from the image reading apparatus to the image forming apparatus. The system controls conveyance of the original so that a first side becomes a side that faces an image forming unit if the first side of the original is designated as the image formation side or so that a second side becomes the side that faces the image forming unit if the second side of the original is designated as the image formation side.

20 Claims, 21 Drawing Sheets

(56) References Cited

U.S. PATENT DOCUMENTS

| | | | |
|---|---|---|---|
| 9,203,994 | B2 | 12/2015 | Kato et al. |
| 9,395,672 | B2 | 7/2016 | Kaneko et al. |
| 9,521,282 | B2 | 12/2016 | Kato et al. |
| 2013/0293909 | A1 | 11/2013 | Endo et al. |
| 2014/0321897 | A1 | 10/2014 | Ogata et al. |

FIG. 17A

| ORIGINAL TYPE | PRINT SETTING | NUMBER OF TIMES OF REVERSAL IN IMAGE READING APPARATUS | NUMBER OF TIMES OF REVERSAL IN IMAGE FORMING APPARATUS |
|---|---|---|---|
| SINGLE-SIDED ORIGINAL (NORMAL PLACEMENT) | SAME SIDE PRINTING | EVEN NUMBER | EVEN NUMBER |
| | OPPOSITE SIDE PRINTING | ODD NUMBER | ODD NUMBER |
| DOUBLE-SIDED ORIGINAL | DOUBLE-SIDED PRINTING | ODD NUMBER | ODD NUMBER |
| SINGLE-SIDED ORIGINAL (OPPOSITE PLACEMENT) | SAME SIDE PRINTING | ODD NUMBER | ODD NUMBER |
| | OPPOSITE SIDE PRINTING | EVEN NUMBER | EVEN NUMBER |

FIG. 17B

| ORIGINAL TYPE | PRINT SETTING | TOP EDGE IS LEADING EDGE | | BOTTOM EDGE IS LEADING EDGE | |
|---|---|---|---|---|---|
| | | LEFT AND RIGHT SPREAD | ABOVE AND BELOW SPREAD | ABOVE AND BELOW SPREAD | LEFT AND RIGHT SPREAD |
| SINGLE-SIDED ORIGINAL (NORMAL PLACEMENT) | SAME SIDE PRINTING | 0 DEGREES | 0 DEGREES | 180 DEGREES | 180 DEGREES |
| | OPPOSITE SIDE PRINTING | 180 DEGREES | 0 DEGREES | 0 DEGREES | 180 DEGREES |
| DOUBLE-SIDED ORIGINAL (NORMAL PLACEMENT) | DOUBLE-SIDED PRINTING | "FIRST SIDE: 180 DEGREES SECOND SIDE: 0 DEGREES" | "FIRST SIDE: 0 DEGREES SECOND SIDE: 180 DEGREES" | "FIRST SIDE: 0 DEGREES SECOND SIDE: 180 DEGREES" | "FIRST SIDE: 180 DEGREES SECOND SIDE: 0 DEGREES" |

IMAGE FORMING SYSTEM AND IMAGE FORMING APPARATUS

BACKGROUND OF THE INVENTION

Field of the Invention

The present invention relates to an image forming system and an image forming apparatus having an original reading function.

Description of the Related Art

Although an image forming apparatus such as a copying machine has a reading unit and an image forming unit, generally a conveyance path for conveying an original to the reading unit and a conveyance path for conveying a recording material to the image forming unit are independent. According to Japanese Patent Laid-Open No. 2006-232467, using a conveyance path of a recording material for performing a double-sided print also as a conveyance path for conveying an original is proposed. By virtue of the invention of Japanese Patent Laid-Open No. 2006-232467, it is possible to provide a low cost, compact image forming apparatus since the image forming unit and the reading unit share a conveyance path.

Incidentally, there is a market need in that there is a desire to form an image by further overwriting onto an original read by a reading unit. Because the image forming unit and the reading unit share a conveyance path, it is possible for the invention recited in Japanese Patent Laid-Open No. 2006-232467 to form an image on an original if the original read by the reading unit is improved so as to be guided to the image forming unit. However, because there are a front side and a back side on an original, an image will not be formed on the intended side if the operator does not place the original on the paper feed tray being aware of its front and back.

SUMMARY OF THE INVENTION

Accordingly, the present invention can reduce a burden on an operator at a time of forming an image on an original by overwriting.

The present invention provides an image forming system including an image forming apparatus for forming an image on a recording material and an image reading apparatus for reading an original. The image forming apparatus may comprise: a first main conveyance path configured to convey a recording material from a storage unit to a discharge unit; an image forming unit arranged on the first main conveyance path and configured to form an image on the recording material; a first reversing unit configured to reverse a side of the recording material that faces the image forming unit by reversing a conveyance direction of the recording material after the recording material is conveyed through the first main conveyance path; and a first sub conveyance path configured to convey the recording material after the conveyance direction of the recording material is reversed by the first reversing unit to a first main conveyance path. The image reading apparatus may comprise: a second main conveyance path configured to convey an original fed from a feeding unit; a reading unit arranged on the second main conveyance path and configured to read the original; a second reversing unit configured to reverse a conveyance direction of the original; and a second sub conveyance path configured to convey the original after its conveyance direction is reversed by the second reversing unit to a second main conveyance path, and wherein the image forming system further comprises a connecting conveyance path that branches from the second main conveyance path of the image reading apparatus and joins the first sub conveyance path of the image forming apparatus, and configured to convey the original from the image reading apparatus to the image forming apparatus; a first determination unit configured to determine a first side and a second side of the original based on a result of reading the original by the reading unit; an acceptance unit configured to accept designation information that designates which of the first side and the second side of the original is to be an image formation side; and a conveyance control unit configured to control conveyance of the original in accordance with a result of the determination of the first determination unit so that the first side becomes a side that faces the image forming unit if the first side of the original is designated as the image formation side or so that the second side becomes the side that faces the image forming unit if the second side of the original is designated as the image formation side.

Further features of the present invention will become apparent from the following description of exemplary embodiments (with reference to the attached drawings).

BRIEF DESCRIPTION OF THE DRAWINGS

FIGS. 17A and 17B are views illustrating a table relating a side alignment, a page alignment and an orientation alignment.

DESCRIPTION OF THE EMBODIMENTS

Below, a case of forming an image by overwriting on a first side of a single-sided original on which an image is formed on only a first side (first embodiment), a case in which an image is formed on a second side of a single-sided original (second embodiment), and a case in which an image is formed on both sides of a double-sided original (third embodiment) are described. Note that a fourth embodiment is a variation of the first embodiment (front/back opposite placement). In particular, in the present embodiment, the sides of the original are adjusted inside the image reading apparatus (side alignment) so that a side on which the image is to be formed (image formation side) is facing an image carrier. Because the conveyance path of the image reading apparatus is short compared the conveyance path of the image forming apparatus, it becomes possible to perform adjustment of the sides of the original in a shorter time. There are cases in which the page order at a time of feeding and a page order at a time of discharging becomes unaligned when a plurality of originals are read, images are formed on the originals, and the originals are discharged from the image forming apparatus. For example, there are cases in which the page order at a time of discharging becomes 2, 1, 4, 3, . . . , 10, 9 in spite of the fact that the page order at a time of feeding was 1, 2, 3, 4, . . . , 9, 10. Accordingly, a mechanism for aligning the page order at a time of feeding and a page order at a time of discharging is proposed below (page alignment). Also, while there is no visual distinction between a top edge and a bottom edge in a recording material, there is a distinction between the top edge and the bottom edge of an original because an image is formed on an original. Accordingly, it is necessary to align the orientation of the original and the orientation of an image formed by overwriting (orientation alignment). Accordingly, a unit for forming an image on an original, a unit for side alignment, a unit for orientation alignment, and a unit for page alignment are described below.

First Embodiment

Figure 1:
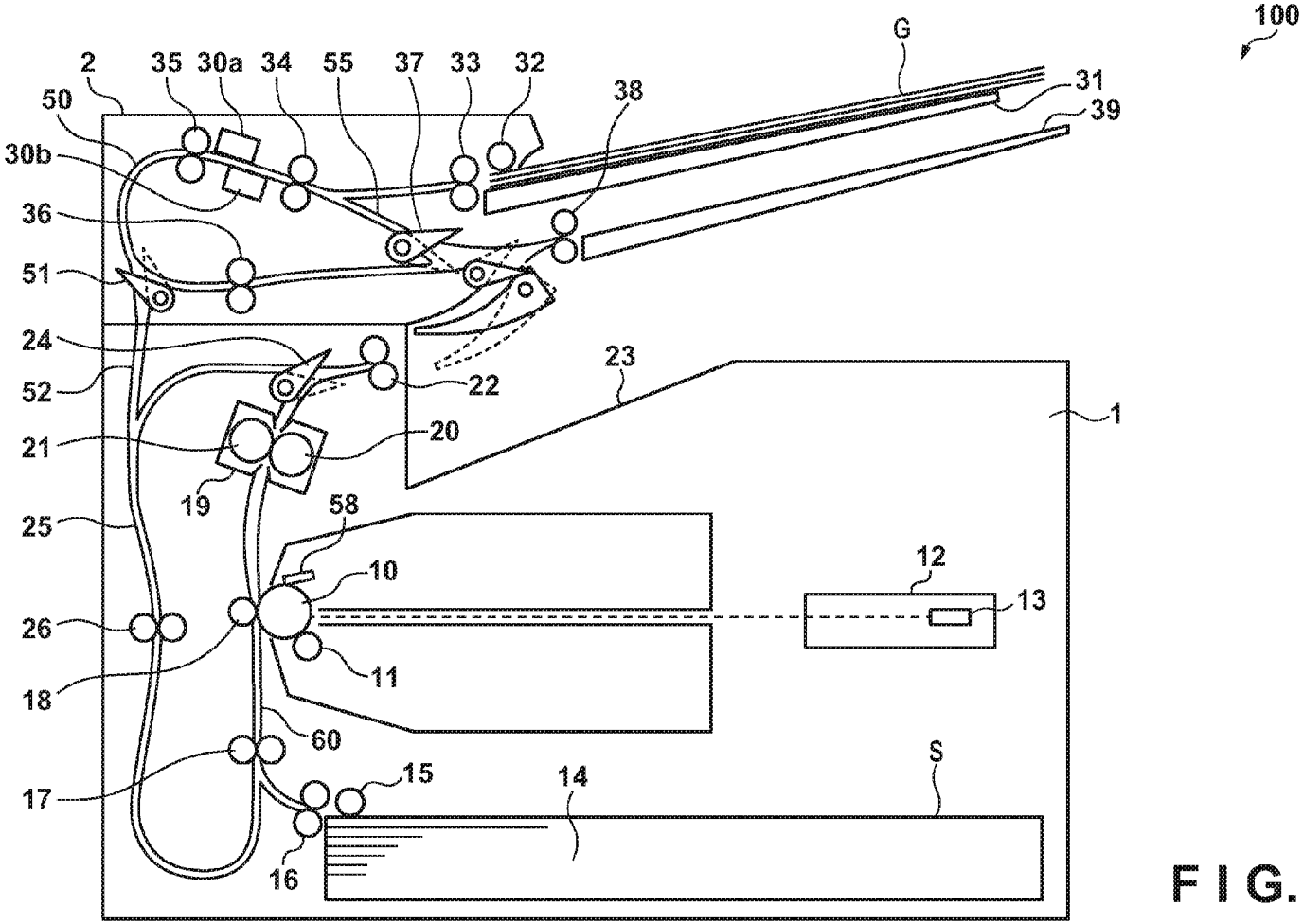
FIG. 1 is an overview cross-sectional view illustrating an image forming system.

FIG. 1 is an overview cross-sectional view illustrating an image forming system 100 having an image reading apparatus 2 and an image forming apparatus 1. Although an electrophotographic type laser beam printer is employed, another image forming method such as an electrostatic recording method, an ink-jet method, a thermal transfer method or the like may be employed as the image forming apparatus 1 in the present embodiment. The image reading apparatus 2 employs a sheet-through method image scanner that reads an original by image sensors while the original is conveyed (sub-scanning) by an automatic document feeder (ADF).

Image Forming Process

The image forming apparatus 1 is a printer engine that forms a toner image by an electrophotographic process in FIG. 1. A photosensitive drum 10 is a rotatable image carrier for carrying an electrostatic latent image or a toner image and functions as the main portion of an image forming unit. A charger 58 causes the front side of the photosensitive drum 10 to be uniformly charged. A light emitting unit 13 that an optical scanner 12 is equipped with forms an electrostatic latent image by emitting a laser beam according to an image signal onto the photosensitive drum 10 while main scanning. The optical scanner 12 may be called an exposure unit. A developing roller 11 of a developer develops an electrostatic latent image by using toner and generates a toner image.

A recording material S set in a first feeding unit 14 is conveyed by a paper feed roller 15 and a separating unit 16 one at a time to registration rollers 17. The registration rollers 17 convey the recording material S to a transfer unit 18 so that a timing at which the toner image carried on the photosensitive drum 10 reaches the transfer unit 18 and a timing at which the recording material S reaches the transfer unit 18 are aligned. The transfer unit 18 and the photosensitive drum 10 form a nip portion for transferring the image. The transfer unit 18 transfers the toner image on the photosensitive drum 10 to the recording material S by an applied bias and pressure. Furthermore, the recording material S is conveyed to a fixing unit 19. The fixing unit 19 adds heat to the toner image and the recording material S by a heating roller 20. Furthermore, the fixing unit 19 causes the toner image to be fixed to the recording material S by adding pressure to the toner image and the recording material S by the heating roller 20 and a pressure roller 21. Discharging rollers 22 discharge the recording material S on which the toner image is fixed to a first discharge unit 23. Note, the photosensitive drum 10, the optical scanner 12, the developing roller 11, and the transfer unit 18 form an image forming unit (station).

The conveyance path connecting from the first feeding unit 14 to the first discharge unit 23 is called a first main conveyance path 60. The discharging rollers 22 function as a reversing unit that reverses the conveyance direction of the recording material S. In a case where the original G is supplied from the image reading apparatus 2 as a recording material S, the discharging rollers 22 may discharge or reverse the original G. The front side and the back side of the recording material S are switched by reversing the conveyance direction of the recording material S. The reversing unit functions when it is necessary to switch the front side and the back side of the recording material S such as when a double-sided print is instructed. The rotation direction of the discharging rollers 22 may be switched by a switching mechanism such as a clutch or a gear, and a motor itself which is a driving source may be rotated in reverse. A flapper 24 is arranged between the fixing unit 19 and the discharging rollers 22. The flapper 24 moves between an initial position (first position) illustrated by the solid line and a position (second position) indicated by the broken line in FIG. 1. Alternatively, the flapper 24 may be biased by an elastic member in a clockwise direction such that the position indicated by the broken line in FIG. 1 is the initial position. In such a case, the flapper 24 moves to the position indicated by the solid line in FIG. 1 being pushed open by the leading edge of the recording material S. When single-sided printing is instructed, the recording material S passes through the flapper 24 and reaches the discharging rollers 22, and is discharged to the first discharge unit 23 as is. In a double-sided print, when the image is printed on the first side of the recording material S and the trailing edge of the recording material S passes through the flapper 24, the flapper 24 is switched to the position illustrated by the broken line, and also the discharging rollers 22 rotate in reverse. The recording material S conveyed in a reverse direction by the discharging rollers 22 is guided to a first sub conveyance path 25 by the flapper 24. The first sub conveyance path 25 is a conveyance path from the discharging rollers 22 to the registration rollers 17 (a joint portion with the first main conveyance path 60). After this, the recording material S is conveyed by conveyance rollers 26 to the registration rollers 17. The second side of the recording material S faces the photosensitive drum 10 because the front and back of the recording material S are reversed in the reversing unit. A toner image is transferred to the second side by the transfer unit 18. The fixing unit 19 causes the image to be fixed on the second side. After this, the discharging rollers 22 discharge the recording material S to the first discharge unit 23. In this way, the first main conveyance path 60 and the first sub conveyance path 25 form a circulating path that the recording material S circulates in. The circulating path has a reversing unit, is approximately ring-shaped, and the front and back of the recording material S are reversed whenever the recording material S makes one round.

Image Read Process

In FIG. 1, the image reading apparatus 2 is equipped with a second feed unit 31 on which the original G is placed, a paper feed roller 32 and a separating unit 33 that feed one at a time the originals G placed on the second feed unit 31. A second main conveyance path 50 is a conveyance path from the paper feed roller 32 to discharging rollers 38. An image sensor 30*a* that reads the top side and an image sensor 30*b* that reads the bottom side of the original G is equipped in the second main conveyance path 50. The image sensors 30*a* and 30*b* are CIS (contact image sensors) or the like, and have a photoelectric conversion element such as a CMOS sensor or a CCD sensor. Also, the conveyance rollers 34, 35, and 36 and the discharging rollers 38 that convey the original G are arranged in the second main conveyance path 50. The discharging rollers 38 discharge the original G to a second discharge unit 39. A flapper 37 is arranged to the front of the discharging rollers 38. The flapper 37 moves between an initial position (first position) illustrated by the solid line and a position (second position) indicated by the broken line in FIG. 1. Alternatively, the flapper 37 may be biased by an elastic member in a clockwise direction such that the position indicated by the broken line in FIG. 1 is the initial position. In such a case, the flapper 37 moves to the position indicated by the solid line being pushed open by the leading edge of the recording material S. The rotation direction of the discharging rollers 38 can be reversed. The originals G placed on the second feed unit 31 pass through the image sensors 30*a* and 30*b* conveyed by the conveyance rollers 34 after being fed one at a time by the paper feed roller 32 and the separating unit 33, and the front side (top side) and the back side (bottom side) of the originals G are read. The original G, after passing through the image sensors 30*a* and 30*b*, is conveyed by the conveyance rollers 35 and the conveyance rollers 36 to the discharging rollers 38. The flapper 37 is in an initial position when the trailing edge of the original G passes through the flapper 37. The original G that reached the discharging rollers 38 is discharged to the second discharge unit 39 by the discharging rollers 38.

Overwriting Print Process

The process for forming an image onto the original G on which an image is already formed is called an overwriting print process. A flapper 51 is arranged in the middle of the second main conveyance path 50. The flapper 51 guides the original G to the discharging rollers 38 by moving to the position indicated by the solid line. The flapper 51 guides the original G to a contact path 52 by moving to the position indicated by the broken line. The second main conveyance path 50 branches to a conveyance path towards the discharging rollers 38 and the contact path 52 which is a conveyance path towards the image forming apparatus 1 as FIG. 1 illustrates. The flapper 51 is arranged at the branch portion. The contact path 52 converges or connects to the first sub conveyance path 25 within the image forming apparatus 1.

Direct Print Mode

Figure 2A:
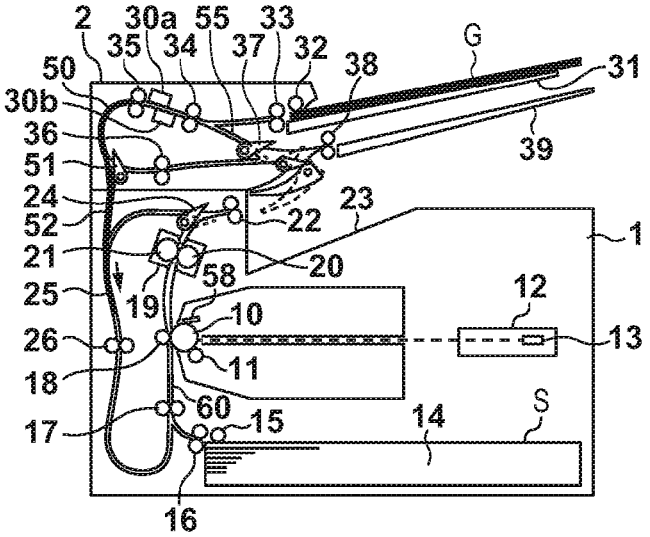
FIGS. 2A to 2C are views illustrating an example of conveying an original.

The original G is conveyed to the first sub conveyance path 25 of the image forming apparatus 1 through the contact path 52 when the flapper 51 is in the position indicated by FIG. 2A. The original G is conveyed to the registration rollers 17 by the conveyance rollers 26 and the image on the original G is overwritten (image formation process) by the photosensitive drum 10. In this way, the original G is guided to the contact path 52 by the flapper 51 switching to the broken line position and the image on the original G is overwritten when the original G read by the image sensors 30*a* and 30*b* reaches the flapper 51.

Temporary Wait Mode (Reversal of Conveyance Direction/Reversal of Front and Back)

Figure 2B:
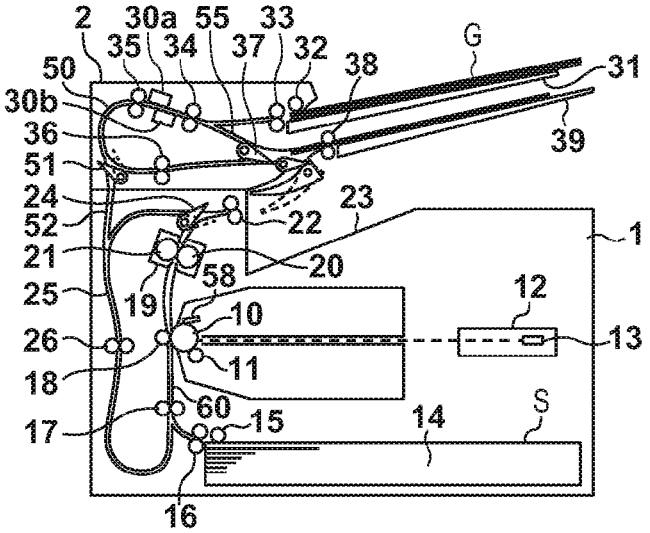
Figure 2C:
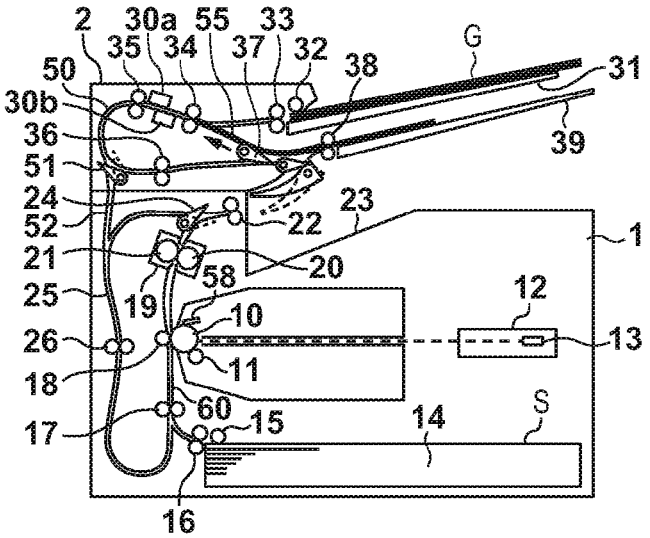

Prior to the original G being conveyed to the image forming apparatus 1, it is possible to cause a temporary wait in the image reading apparatus 2. The original G read by the image sensors 30*a* and 30*b* is guided to the discharging rollers 38 by the flapper 51 held in advance at the solid line position of FIG. 1. The original G is caused to wait by the discharging rollers 38 temporarily stopping conveyance of the original G when the trailing edge of the original G passes the flapper 37 as FIG. 2B illustrates. It is possible to save time for generating content for which overwrite printing is performed by analyzing image information of the read original G while waiting. For example, the image forming system 100 may obtain an identification number printed on the original G and download image data associated in advance with the identification number from a server or the like. After this, the flapper 37 moves to the solid line position indicated in FIG. 2B. The rotation direction of the discharging rollers 38 is switched from forward rotation to reverse rotation and the original G is guided to the second sub conveyance path 55 as FIG. 2C illustrates. The original G converges to the second main conveyance path 50 again via the second sub conveyance path 55. The second sub conveyance path 55 connects to the second main conveyance path 50 upstream of the conveyance rollers 34 in the conveyance direction. After this, the flapper 51 moves to the broken line position of FIG. 1 and the original G is guided to the contact path 52 as FIG. 2A illustrates when the original G again reaches the flapper 51. By this, an image is formed onto the original G.

Control Unit

Figure 3:
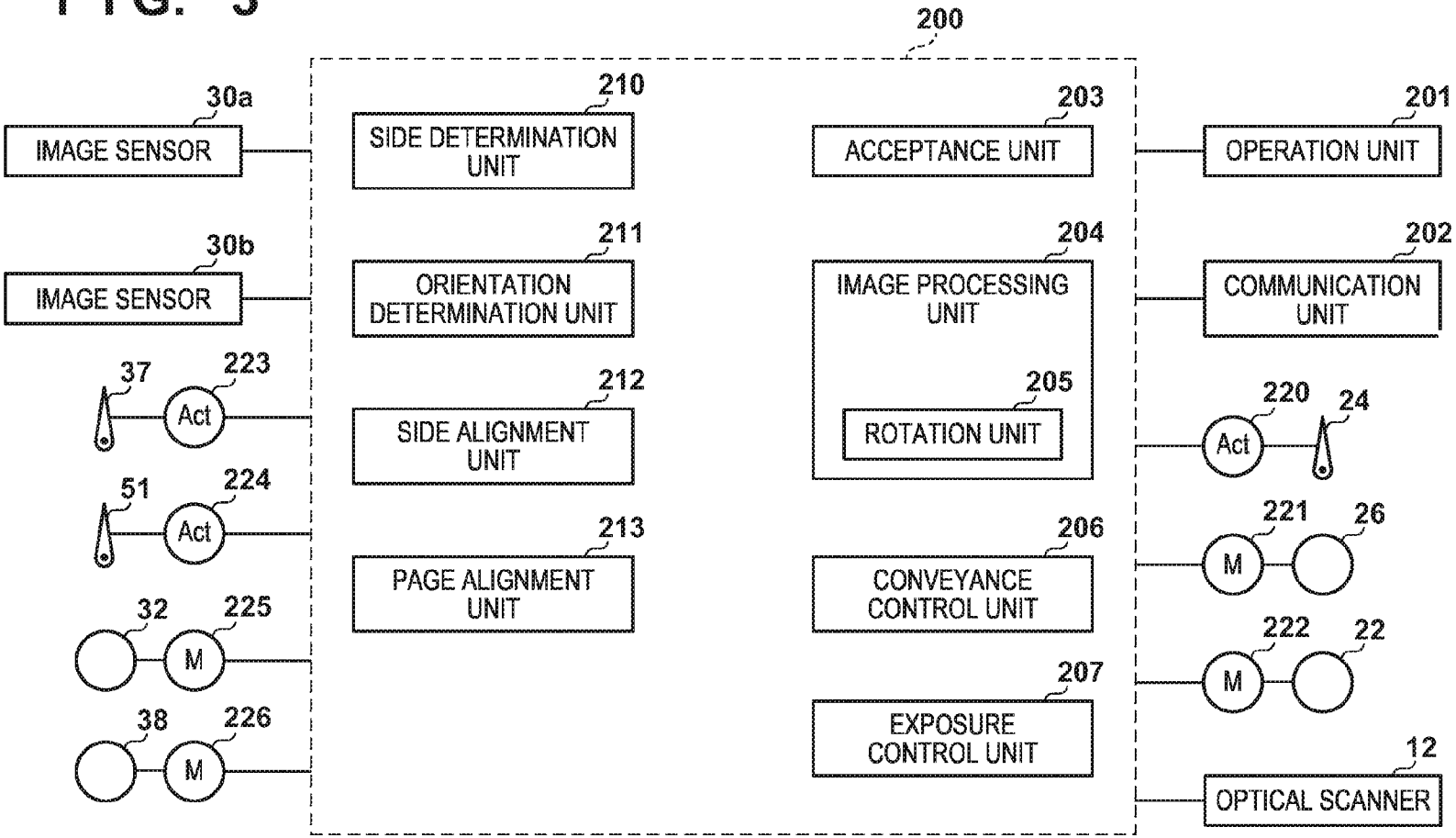
FIG. 3 is a block diagram illustrating a control unit.

FIG. 3 illustrates a control unit 200 that controls the image forming system 100. A plurality of functions that the control unit 200 is equipped with may be implemented by a CPU executing a control program stored in a storage apparatus, and may be implemented by an ASIC (application specific integrated circuit) or an FPGA (field-programmable gate array). Also, each function of the control unit 200 may be implemented by a mixture of these. In other words, some functions may be implemented by software and the remaining functions may be implemented by hardware.

An operation unit 201 and a communication unit 202 are connected to the control unit 200. The operation unit 201 has an input unit for inputting instructions from an operator and a display unit for displaying information and operation menus to the operator. The communication unit 202 connects to a host computer, receives instructions from the operator, and receives image data. An acceptance unit 203 accepts instructions inputted from the operation unit 201 or the communication unit 202. An image processing unit 204 generates image data from image signals obtained by reading the original G by the image sensors 30*a* and 30*b*. A rotation unit 205 executes image rotation processing so as to match the orientation of an image in accordance with the orientation of the original G, the orientation of the recording material S (vertical placement/horizontal placement), or the like. A conveyance control unit 206 controls the position of the flapper 24 by driving an actuator 220. The conveyance control unit 206 causes the conveyance rollers 26 to rotate by driving a motor 221. The conveyance control unit 206 causes the discharging rollers 22 to rotate by driving a motor 222. Note, motors 221 and 222 may be unified as a single driving source in a case when the reversal mechanism described above is employed. The conveyance control unit 206 controls the position of the flapper 37 by driving an actuator 223. The conveyance control unit 206 controls the position of the flapper 51 by driving an actuator 224. The conveyance control unit 206 causes the paper feed roller 32, the separating unit 33, and the conveyance rollers 34 to rotate by driving a motor 225. The conveyance control unit 206 causes the discharging rollers 38 to rotate by driving a motor 226. Note, motors 225 and 226 may be unified as a single driving source in a case when the reversal mechanism described above is employed. An exposure control unit 207 outputs a density signal according to image data output from the image processing unit 204 to the optical scanner 12.

A side determination unit 210 determines which of a first side and a second side of the original G is fed facing upward based on a result of reading the original G by the image sensors 30*a* and 30*b*. Note that the side determination unit 210 may determine the first side and the second side of the original based on the result of reading the original G. In the case of a single-sided original, an image is formed on the first side, and no image is formed on the second side. Accordingly, the side determination unit 210 determines which of the image sensors 30*a* and 30*b* was able to obtain an image based on the read results of the image sensors 30*a* and 30*b*. If the image sensor 30*a* was able to obtain an image, the side determination unit 210 determines that the first side is fed facing upward. If the image sensor 30*b* was able to obtain an image, the side determination unit 210 determines that the second side is fed facing upward. A direction determination unit 211 determines which of a top edge and a bottom edge of the original G is fed from the paper feed roller 32 as the leading edge. The direction determination unit 211 may be called a direction determination unit. Here, the top edge means the edge that is visually on the top side in the original G. The bottom edge means the edge that is visually on the bottom side in the original G. The right edge means the edge that is visually on the right side in the original G. The left edge means the edge that is visually on the left side in the original G. The leading edge is the edge that is facing the direction in which the original G is conveyed. The trailing edge is the edge that is facing the opposite direction to the direction in which the original G is conveyed. The direction determination unit 211 may determine which of the right edge and the left edge of the original G is fed from the paper feed roller 32 as the leading edge. For example, the direction determination unit 211 may read a character formed on the original G by the image sensors 30*a* and 30*b*, and recognize the character. When a character can be recognized, the direction determination unit 211 determines the orientation based on a rotation angle of the image. For example, if the rotation angle is 0 degrees, the direction determination unit 211 determines that the top edge of the original G is the leading edge in the conveyance direction. If the rotation angle is 90 degrees, the direction determination unit 211 determines that the left edge of the original G is the leading edge in the conveyance direction. If the rotation angle is 180 degrees, the direction determination unit 211 determines that the bottom edge of the original G is the leading edge in the conveyance direction. If the rotation angle is 270 degrees, the direction determination unit 211 determines that the right edge of the original G is the leading edge in the conveyance direction.

A side alignment unit 212 controls the sides of the original G so that the side (image formation side) on which an image is to be formed among the first side and the second side of the original G faces the photosensitive drum 10. The side of the original G is controlled by conveyance direction/the number of reversals of the sides according to the discharging rollers 38. A page alignment unit 213 controls conveyance of a plurality of the original G to align the page order of the plurality of the original G when they are placed in the second feed unit 31 and a page order of the plurality of the original G discharged to the first discharge unit 23. For example, if the plurality of the original G are arranged in order from a first page to a tenth page at a time of feeding, it arranges the plurality of the original G in order from the first page to the tenth page at a time of discharging.

Overwrite Printing to a Single-Sided Original

Using FIG. 4A to FIG. 6C, conveyance control at a time of overwrite printing to a single-sided original is described. A single-sided original means an original to which an image is printed on only a first side of the original G. Here, it is assumed that an image is to be further formed on the first side on which the image is already formed. In FIG. 4A to FIG. 6C, a ▼ mark is added to the top edge for convenience in the front side (the first side) of the original G so that the sides of the original G and the orientation of the original G can be known. The ▼ mark is not necessarily printed on the first side of the original G.

Figure 4A:
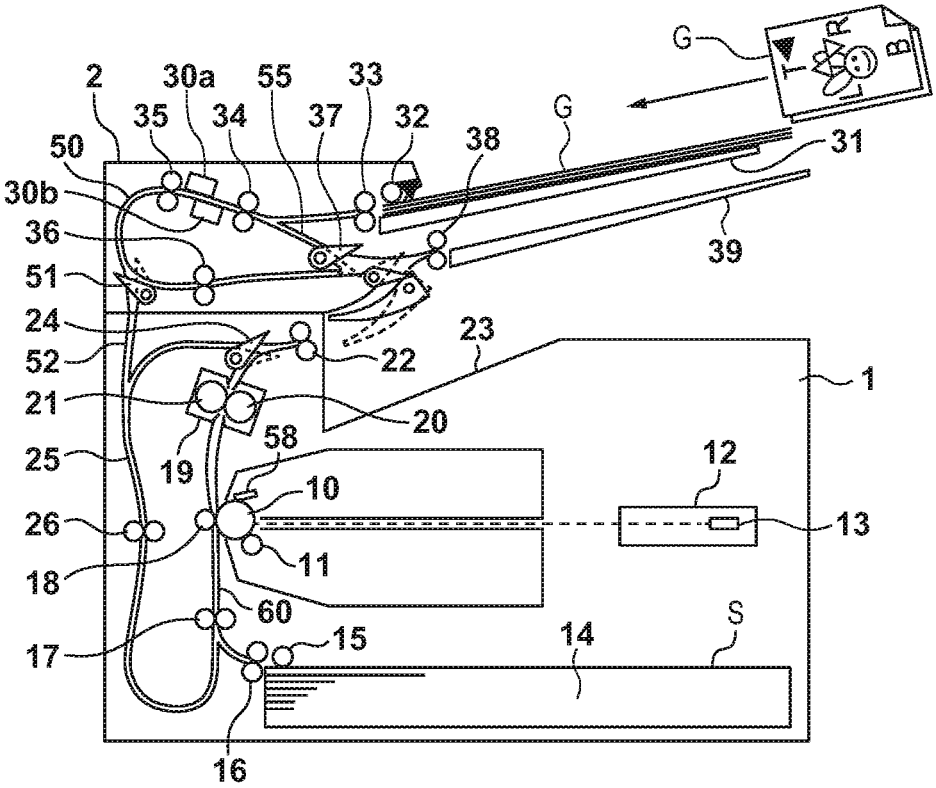
FIGS. 4A to 4C are views illustrating an example of conveying an original.

A plurality of the original G are placed in the second feed unit 31. The page number of the original G that is placed highest is the smallest, and the page number of the original G that is placed lowest is the largest. In this way, a plurality of the original G are placed according to the page order. As FIG. 4A illustrates, the top edge of the original G faces the conveyance direction. In other words, the top edge of the original G is conveyed as the leading edge. The acceptance unit 203 accepts image data and an instruction to print an image on a first side of a single-sided original through the operation unit 201, the communication unit 202, or the like.

Figure 4B:
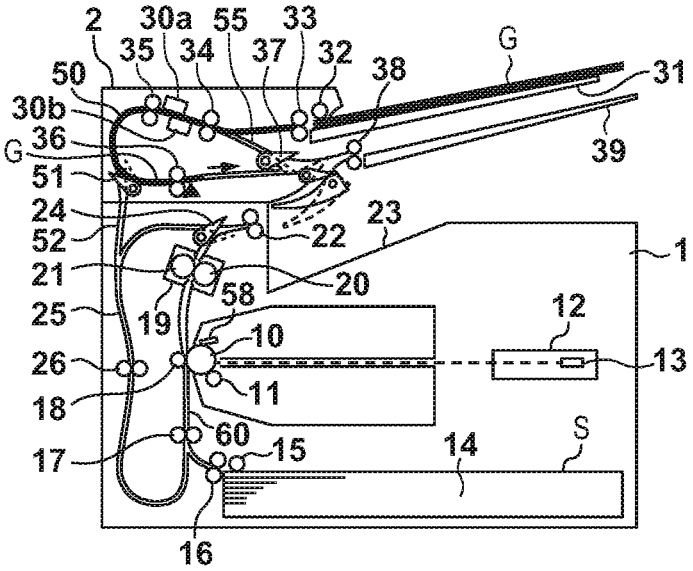
Figure 4C:
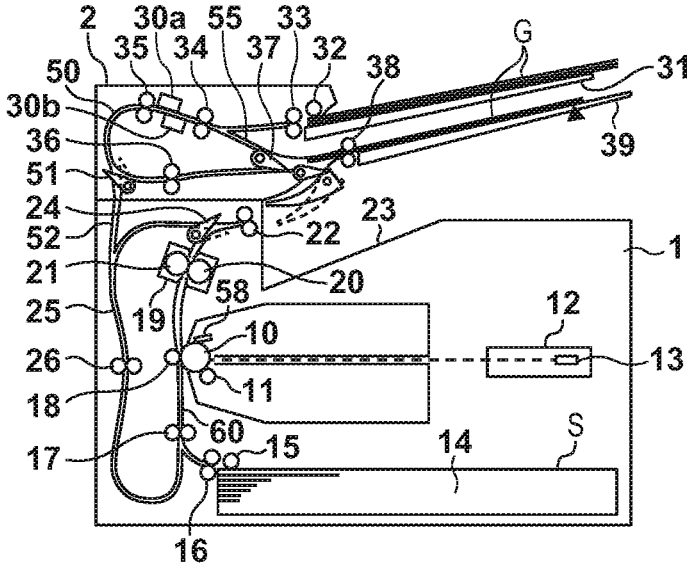
Figure 5A:
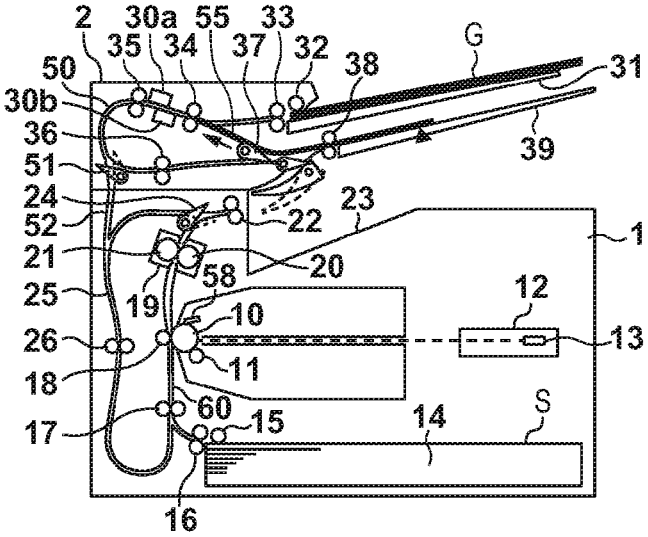
FIGS. 5A to 5C are views illustrating an example of conveying an original.
Figure 5B:
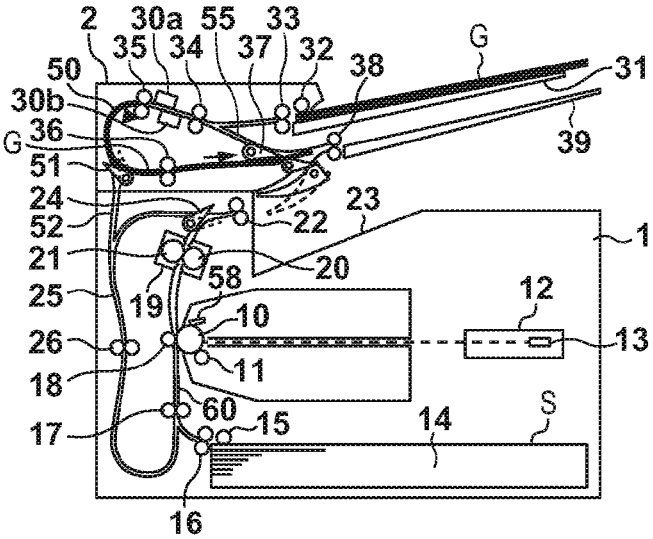
Figure 5C:
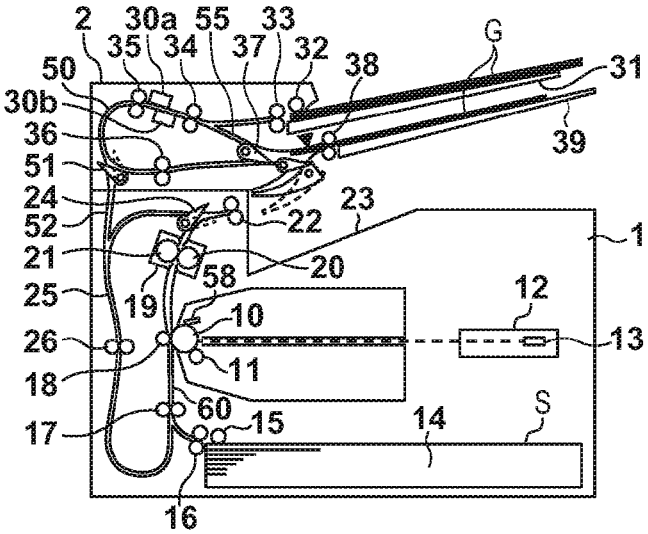
Figure 6A:
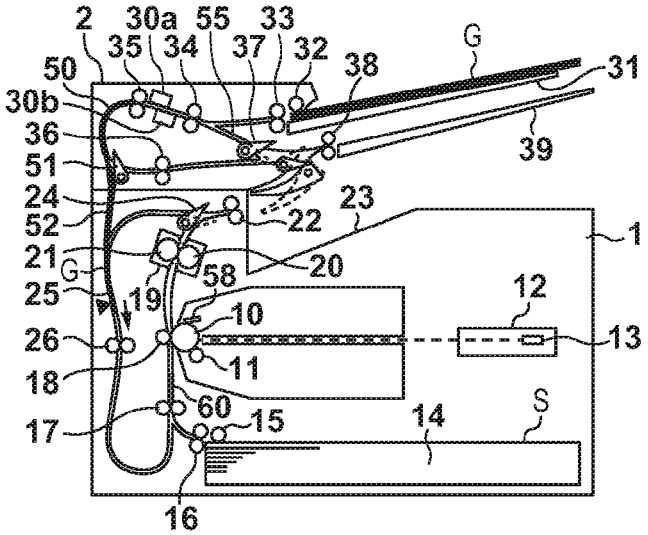
FIGS. 6A to 6C are views illustrating an example of conveying an original.
Figure 6B:
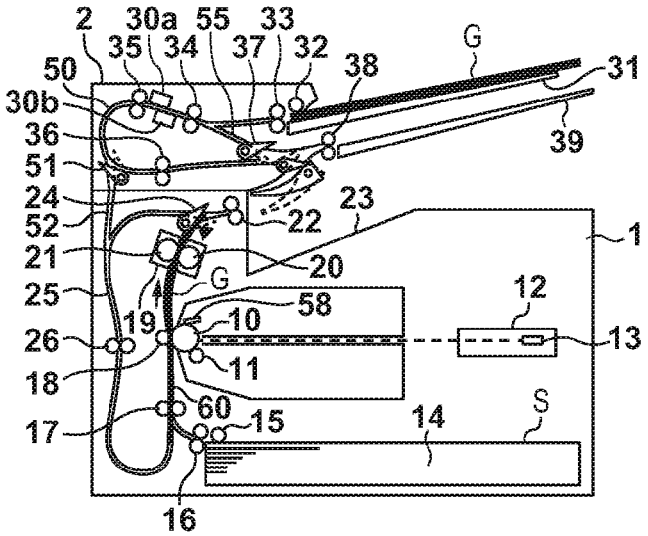

As FIG. 4A illustrates, the conveyance control unit 206 causes the paper feed roller 32 or the like to rotate. As FIG. 4B illustrates, the image processing unit 204 reads both the first side and the second side of the original G by controlling the image sensors 30*a* and 30*b*. Preparation time for overwrite printing is necessary. For that, as FIG. 4C illustrates, the conveyance control unit 206 guides the original G to the second discharge unit 39 by controlling the flapper 51. The side determination unit 210 determines that the original G is a single-sided original, and the first side is fed facing upward based on the read results of each of the image sensors 30*a* and 30*b*. The direction determination unit 211 determines that the top edge of the original G is fed so as to be the leading edge in the conveyance direction based on a character recognition result for the first side. The side alignment unit 212 determines on which of the first side and the second side of the original G to form the image on based on the instruction accepted by the acceptance unit 203. Here, it is assumed that the forming of an image on the first side on which the image is already formed is instructed (same side print). The side alignment unit 212 decides the side of the original G that is conveyed to the contact path 52 so that the image is formed on the original G on the side designated based on the instruction. Specifically, the side alignment unit 212 controls the orientation and the side of the original G when the contact path 52 is passed through so that the first side of the original G becomes the side that faces the photosensitive drum 10. As FIG. 5A illustrates, the conveyance control unit 206 starts conveying the original G to the contact path 52 from the second discharge unit 39 so as to end up with the side that the side alignment unit 212 decided. If the flapper 51 is switched and the original G is conveyed to the contact path 52 at that time, an image is overwritten on the second side (back side) of the original G. Accordingly, as FIG. 5B and FIG. 5C illustrate, the conveyance control unit 206 feeds the original G to the second discharge unit 39 again without switching the flapper 51. After that, the conveyance control unit 206 causes the direction of conveyance of the original G to reverse and then feeds the original G to the second sub conveyance path 55. As FIG. 6A illustrates, the conveyance control unit 206 guides the original G to the contact path 52 by switching the flapper 51. By this, the conveyance control unit 206 causes the original G to pass through the transfer unit 18 so that the image is transferred to the first side of the original G as FIG. 6B illustrates. The rotation unit 205 determines whether the original G enters the image forming unit from the top edge or enters from the bottom edge based on the determination result of the direction determination unit 211, and the number of reversals of the conveyance direction of the original G. The rotation unit 205 decides the rotation angle of the image formed by the image forming unit based on the result of determining the orientation, and causes image data to rotate in accordance with the decided rotation angle. By this, the orientation of the image and the orientation of the original G are aligned. At this time, an image is overwritten on the original G without the rotation unit 205 causing the image to rotate because the original G has been conveyed to the transfer unit 18 so that the top edge of the original G becomes the leading edge in the conveyance direction.

Figure 6C:
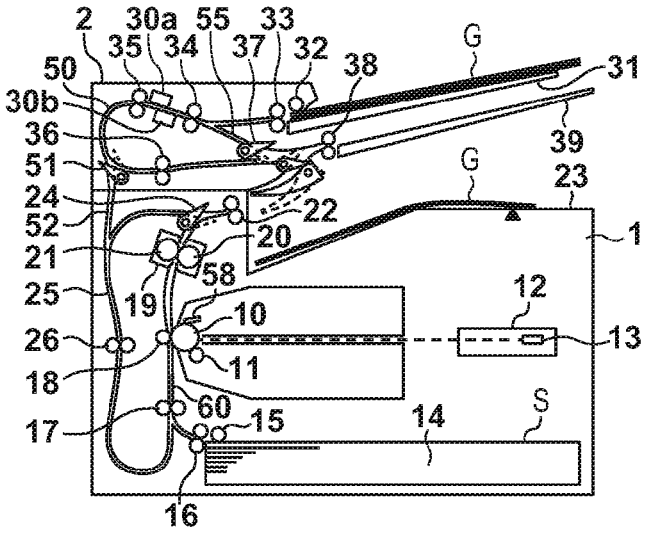

By executing the conveyance control in this way it becomes possible to correctly overwrite the image on the first side of the original G. Furthermore, as FIG. 6C illustrates, the original G is discharged to the first discharge unit 23 (face down discharge) so that the first side of the original G becomes downward. Accordingly, even if single-sided printing and consecutive discharge are carried out for a plurality of the original G, the original page order is reproduced. Here, it is possible to adjust the side of the original G by causing the original G to circulate in a circulation conveyance path in the image forming apparatus 1. However, in the present embodiment, the original G is conveyed to the contact path 52 after the sides of the original G are adjusted in the circulation conveyance path in the image reading apparatus 2. Accordingly, the original G does not circulate through the circulation conveyance path in the image forming apparatus 1. The conveyance distance of the circulation conveyance path in the image reading apparatus 2 is shorter than a conveyance distance of the circulation conveyance path in the image forming apparatus 1. Accordingly, the present embodiment can adjust the sides of the original G in a shorter time.

In the present embodiment, a case in which the original G is a single-sided original is described, but the present embodiment can be applied even in a case in which an image is overwritten to only the first side of the original G even if the original G is an original (double-sided original) on which images are printed on both sides. However, it is assumed that the first side of the original G is placed on the second feed unit 31 facing upward. This is because when images are formed on both sides of the original G, it cannot be determined whether or not the first side of the original G is facing upward. Note that if page numbers are respectively added to the first side and the second side of the original G, it is possible for the side determination unit 210 to determine the first side by character recognition of the page number. Here, the fact that the page number of the first side is smaller than the page number of the second side is used. Note that when the first side of the original G is set oppositely (facing downward) (opposite placement), the second side is fed facing upward. Because a case in which an image is formed on the second side in this state is similar to a case in which the first side is fed facing upward and an image is formed on the first side, similar conveyance control is employed. In such a case, because feeding is in order of descending page number of the original G, and the second side is discharged facing downward, the page order is maintained.

In the present embodiment, the image sensors 30*a* and 30*b* are arranged so as to sandwich the conveyance path as two sensors for the image reading apparatus 2 to read both sides simultaneously. However, the image sensor 30*b* may be omitted. In such a case, it is necessary to read the first side and the second side of the original G by only the image sensor 30*a*. In the present embodiment, after the first side is read, the original G circulates a circulation conveyance path. Specifically, the image sensor 30*a* reads the first side in the step illustrated in FIG. 4B, and reads the second side in the steps illustrated in FIG. 5A and FIG. 5B executed thereafter. Accordingly, the conveyance time in the case of being equipped with two image sensors is the same as the conveyance time in the case of being equipped with one image sensor.

Second Embodiment

In the first embodiment, front side printing (same side print) of a single-sided original is mainly described. In the second embodiment, back side printing (opposite side printing) of a single-sided original is described. Specifically, the second embodiment is a case in which a new image is overwritten on a second side (back side) of a single-sided original on which an image is already formed on the first side (front side). FIG. 7A to FIG. 9C illustrate steps for overwrite printing to an original G in the second embodiment. In the second embodiment as well, a ▼ mark is added to the top edge of the front side (first side) of the original G so that the sides and the orientation of the original G can be known.

Figure 7A:
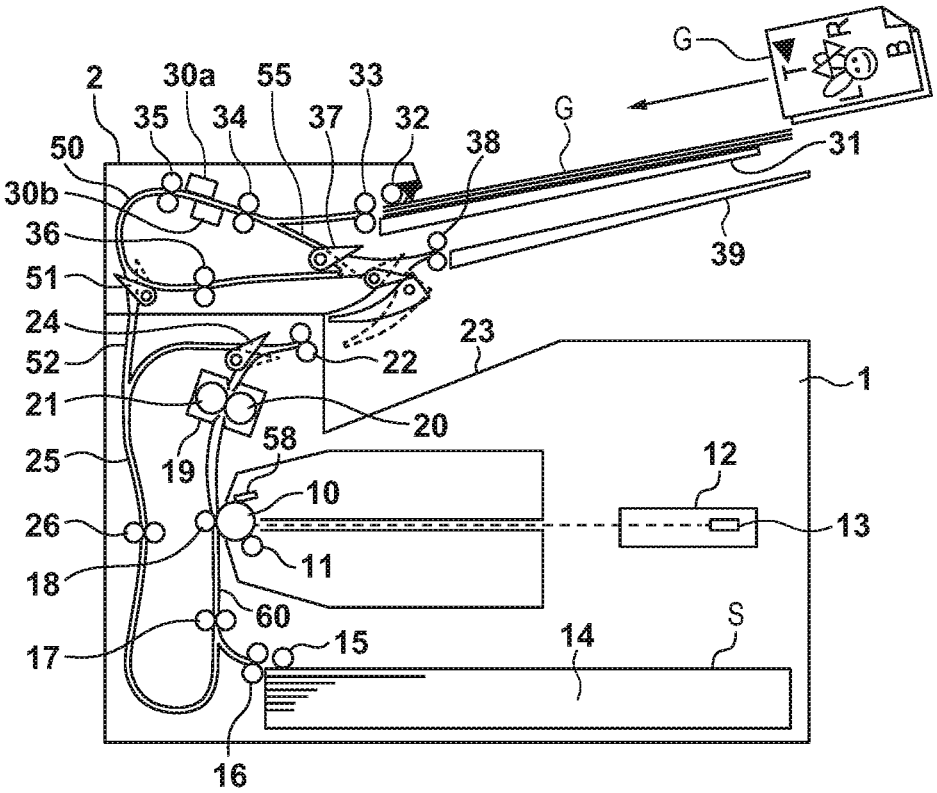
FIGS. 7A to 7C are views illustrating an example of conveying an original.

In FIG. 7A, a plurality of the original G are placed in the second feed unit 31. Each page number of the plurality of originals G is proportional to the stacking position of the original G. The page number of the original G that is placed highest is the smallest, and the page number of the original G that is placed lowest is the largest. Also, a plurality of the original G are placed so that the top edge of the original G is fed as the leading edge in the conveyance direction. The acceptance unit 203 accepts image data and an instruction to print an image on a second side of a single-sided original through the operation unit 201, the communication unit 202 or the like.

Figure 7B:
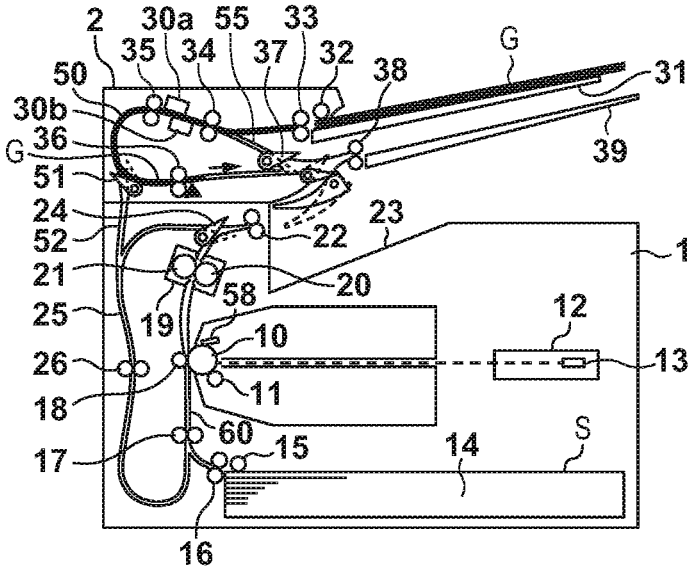
Figure 7C:
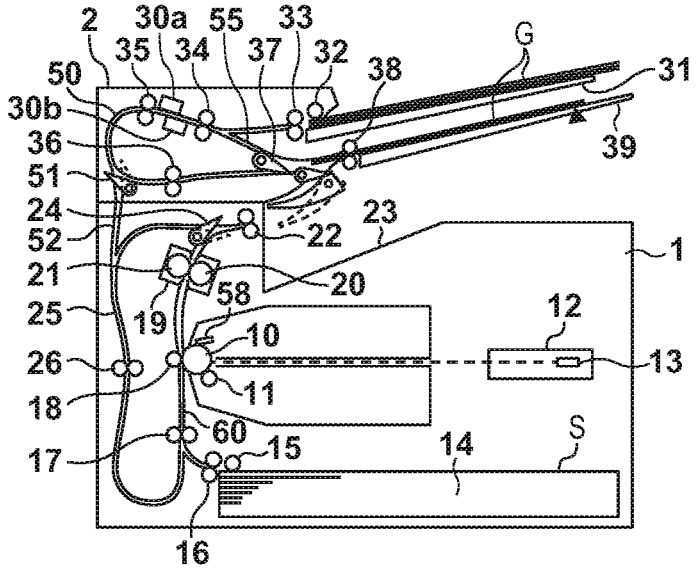

When the conveyance control unit 206 starts conveying the original G as FIG. 7B illustrates, the image sensors 30*a* and 30*b* read the first side and the second side of the original G. The side determination unit 210 determines whether or not the first side is facing upward based on each read result of the image sensors 30*a* and 30*b*. Also, the direction determination unit 211 determines the orientation of the original G based on the result of reading the first side. For example, the direction determination unit 211 determines whether or not the top edge of the original G is fed as the leading edge. The side alignment unit 212 determines whether or not a relation between the side facing upward at the time of passing through the image sensors 30*a* and 30*b* and the image formation side is aligned. It is necessary to guide the original G to the contact path 52 after it passes the image sensor 30*a* with the second side facing upward (so that it faces the image sensor 30*a*) in order to form an image on the second side. As FIG. 7C illustrates, even in the second embodiment, a portion of the original G is first discharged to the second discharge unit 39, and the front and back of the original G and the conveyance direction are reversed. Accordingly, by an original G that was fed with its first side facing upward going around the circulation conveyance path, the original G is switched so that its second side is facing upward, and the second side faces the photosensitive drum 10. Accordingly, the side alignment unit 212 determines that the second side of the original G and the image formation side are aligned, and instructs the conveyance control unit 206 to cause the original G to go around the circulation conveyance path. Note that when the original G is caused to go around the circulation conveyance path, the leading edge and the trailing edge in the conveyance direction of the original G are switched. In other words, the leading edge in the conveyance direction is switched from the top edge to the bottom edge of the original G. The original G enters a nip portion between the photosensitive drum 10 and the transfer unit 18 from its bottom edge. Therefore, the direction determination unit 211 and the rotation unit 205 determine that it is necessary that the image be transferred from its bottom edge side to the original G. The direction determination unit 211 or the rotation unit 205 decides the rotation angle to be 180 degrees, and the rotation unit 205 rotates the image data 180 degrees. A double-sided original is generated by executing opposite side printing on the single-sided original. Here, it is envisioned that a double-sided original double-page spread setting is a left-right double-page spread, but if a top-bottom double-page spread is designated, the direction determination unit 211 determines that rotation of the image is unnecessary. In a left-right double-page spread, the orientation of the image on the first side and the orientation of the image on the second side are aligned, but the orientation of the image on the first side in a top-bottom double-page spread and the orientation of the image on the second side are opposite directions. Accordingly, the rotation angle of a left-right double-page spread and the rotation angle of a top-bottom double-page spread differ by 180 degrees.

Figure 8A:
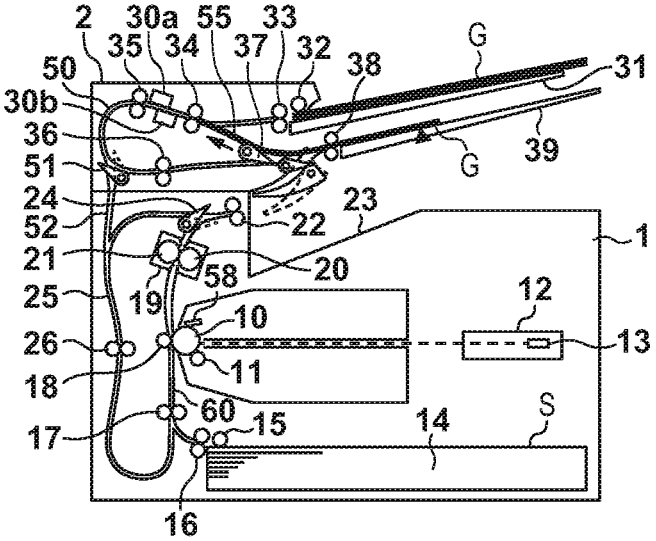
FIGS. 8A to 8C are views illustrating an example of conveying an original.
Figure 8B:
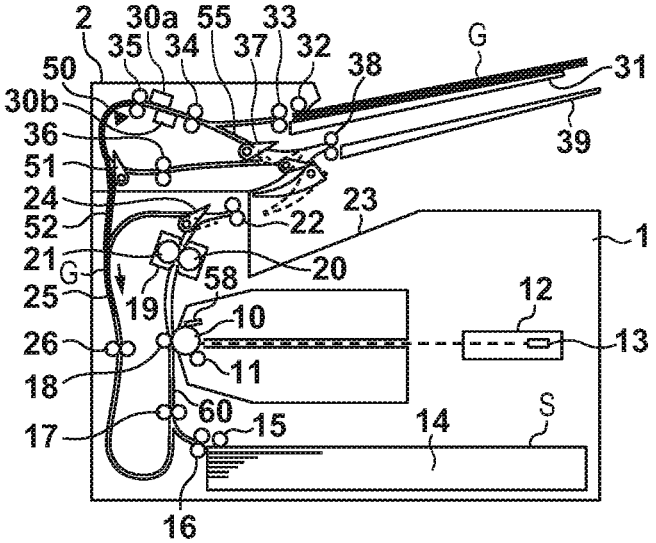
Figure 8C:
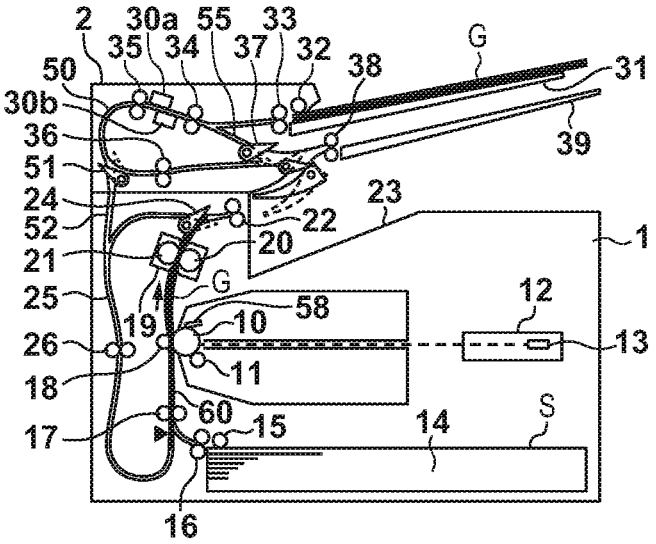

As FIG. 8A illustrates, the conveyance control unit 206 guides the original G from the second discharge unit 39 to the second sub conveyance path 55. As FIG. 8B illustrates, the conveyance control unit 206 switches the flapper 51 so as to guide the original G, whose second side is made to face upward, to the contact path 52. As FIG. 8C illustrates, the second side of the original G contacts the photosensitive drum 10, and the toner image is transferred to the second side.

Figure 9A:
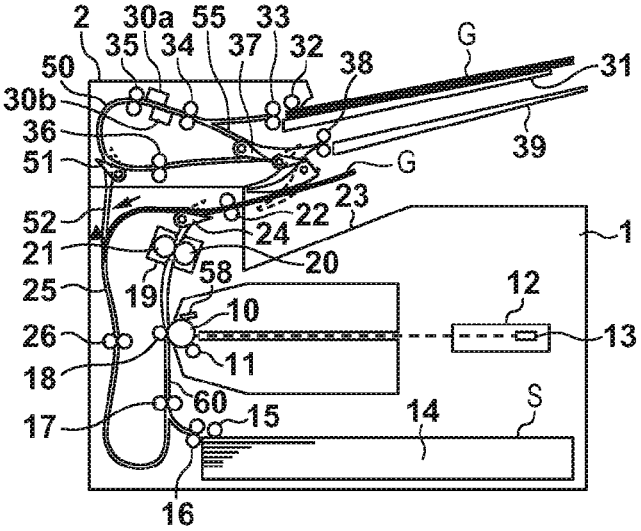
FIGS. 9A to 9C are views illustrating an example of conveying an original.
Figure 9B:
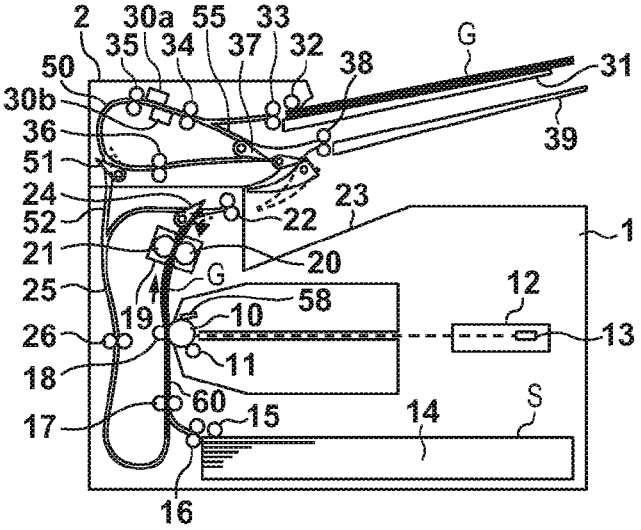
Figure 9C:
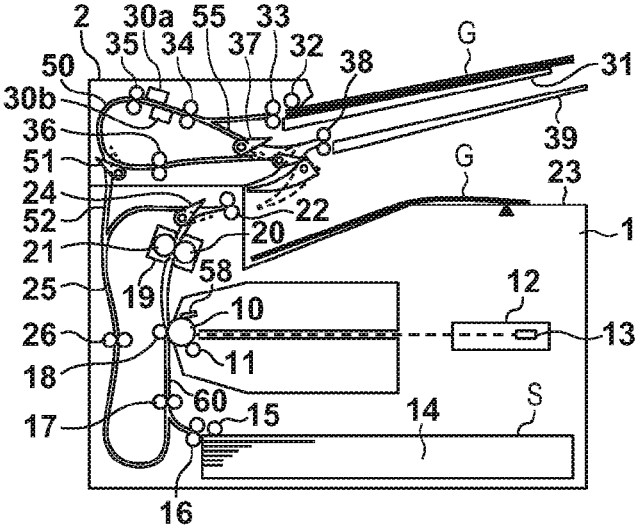

Note that the page order of the plurality of the original G must be kept to the correct order in the first discharge unit 23. When the original G is discharged to the first discharge unit 23 via only the first main conveyance path 60 in the image forming apparatus 1, the original G is discharged with the image formation side facing downward. This is known as a face down discharge. If an image is overwritten on the second side of the original G, and the original G is discharged to the first discharge unit 23 as is, the second side will be facing downward. When it is assumed that the first side is a first page and a second side is a second page, the second page is facing downward. In order to arrange a plurality of the original G which are discharged face down in order of their page numbers, the page with a small page number (first side) must be facing downward in the first discharge unit 23. When the page alignment unit 213 is notified from the side alignment unit 212 that the image is formed on the second side, the conveyance control unit 206 is instructed to cause the original G to go around the circulation conveyance path in the image forming apparatus 1. In other words, the page alignment unit 213 instructs the conveyance control unit 206 so that the front and back of the original G are caused to be reversed. The conveyance control unit 206 causes the flapper 24 to switch when the trailing edge of the original G (top edge) reaches the flapper 24 and causes the rotation direction of the discharging rollers 22 to reverse based on the instruction. By this, as FIG. 9A illustrates, the original G is guided to the first sub conveyance path 25. Because the conveyance direction of the original G is reversed, this time the top edge is the leading edge, and the bottom edge is switched to be the trailing edge. The flapper 24 returns to the initial position when the trailing edge (bottom edge) of the original G passes through the flapper 24. The conveyance control unit 206 discharges the original G to the first discharge unit 23 by causing it to pass through the transfer unit 18 and the fixing unit 19 again, as FIG. 9B illustrates.

If the image is overwritten to the second side of the original G in this way, the original G is discharged to the first discharge unit 23 via the first sub conveyance path 25 after image formation. The page order of the original G is maintained because the first side of the original G faces down by this. When there is only one of the original G, it is not necessary to worry about the page order. When it is designated in advance that there is only one of the original G through the acceptance unit 203, the page alignment unit 213 determines that the page alignment is unnecessary. The conveyance control unit 206 directly discharges the original G without causing it to pass through the first sub conveyance path 25 because the page alignment unit 213 does not create an instruction for reversing the front and back of the original G for the conveyance control unit 206.

In the present embodiment, a case in which the original G is a single-sided original is described. If an image is overwritten to only the second side of an original G, on both sides of which images are formed, the same conveyance control as with image formation to the second side of a single-sided original is performed. However, it is necessary for the side determination unit 210 to obtain page numbers formed on both sides of the original G by character recognition, and to determine which of the first side and the second side is fed facing upward.

There are cases in which the first side of the original G is placed oppositely (facing downward) to the present embodiment, and the image is formed on the first side. Regarding the conveyance control in such a case, because it is the same as when the second side of the foregoing single-sided original is placed facing downward, the same conveyance control is applied. However, switching (page order alignment processing) between the first side and the second side after image formation is unnecessary. In other words, the conveyance control unit 206 discharges the original G, on the first side of which an image is formed, to the first discharge unit 23 without causing it to pass through the first sub conveyance path 25.

In the second embodiment, the two image sensors 30*a* and 30*b* both read simultaneously, but it is possible to apply the second embodiment even if only the image sensor 30*a* is arranged. After the first side is read to determine the sides of the original G by only the image sensor 30*a*, the second side is read by conveying in reverse the original G using the second sub conveyance path 55. In other words, the flapper 51 guides the original G to the second discharge unit 39 after the first side is read in the conveyance steps illustrated in FIG. 7B to FIG. 7C. Further, the original G is conveyed in reverse, and heads towards the image sensor 30*a* via the second sub conveyance path 55. By this, the image sensor 30*a* reads the second side. The side determination unit 210, by comparing the result of reading the first side and the result of reading the second side, determines which is facing upward. At that point in time the second side passes the image sensor 30*a* facing upward. In the second discharge unit 39, the second side ends up facing downward. Accordingly, the side alignment unit 212 instructs the conveyance control unit 206 to reverse the front and back of the original G. The conveyance control unit 206 controls the flapper 51 or the like, and by again causing the original G to go around the circulation conveyance path, causes the second side of the original G to face the photosensitive drum 10. In this way, even if there is only one image sensor, it is possible to apply the second embodiment.

As described above, even if an image is overwritten to the second side of the original G, it is possible to cause the side and orientation of the original G to be aligned with the side and orientation of the image. Also, the page order of the original G is aligned in the image forming apparatus 1.

Third Embodiment

The third embodiment is a double-sided print to a double-sided original. A double-sided original means an original to which an image is formed on both the first side and the second side. A double-sided print means forming images on both the first side and the second side of the recording material S which is the original G or the like. FIG. 10A to FIG. 12C illustrate steps for conveying an original G in the third embodiment. As described already, a ▼ mark is added to the top edge of the front side (first side) of the original G so that the sides and the orientation of the original G can be known.

Figure 10A:
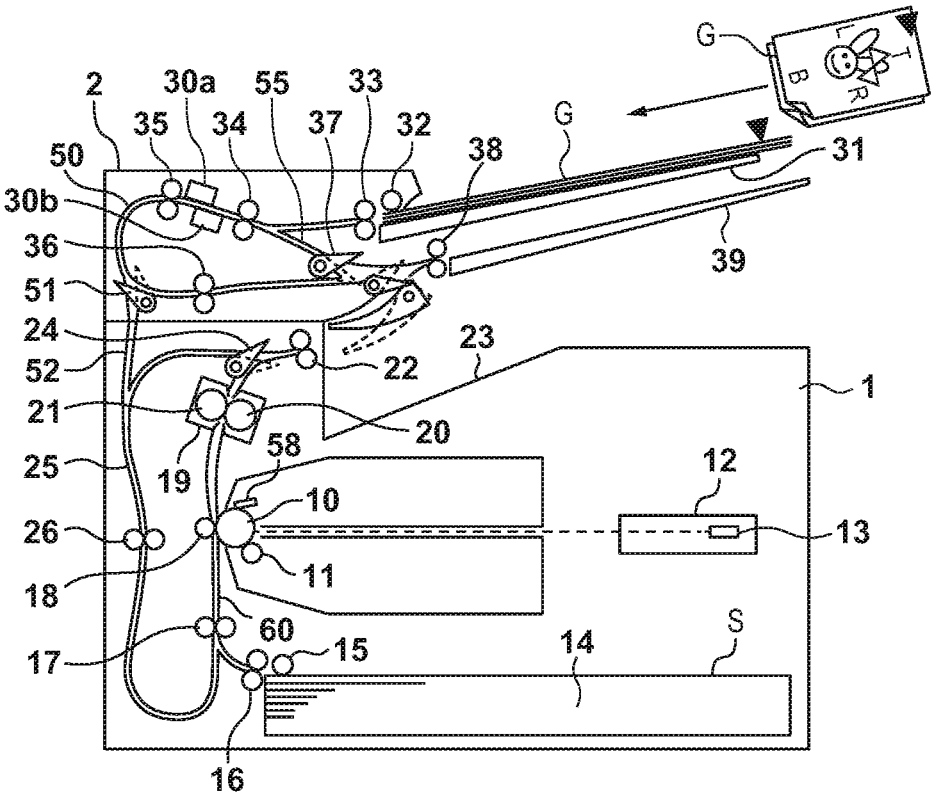
FIGS. 10A to 10C are views illustrating an example of conveying an original.

As FIG. 10A illustrates, a plurality of the original G are stacked from top to bottom in accordance with the order of page numbers. However, a plurality of the original G are placed on the second feed unit 31 so that the bottom edge of the original G becomes the leading edge in the conveyance direction. Also, the first side of the original G is made to be facing upward. The acceptance unit 203 accepts an instruction to print an image on the first side and the second side of the double-sided original, image data for the first side, and image data for the second side through the operation unit 201, the communication unit 202 or the like.

Figure 10B:
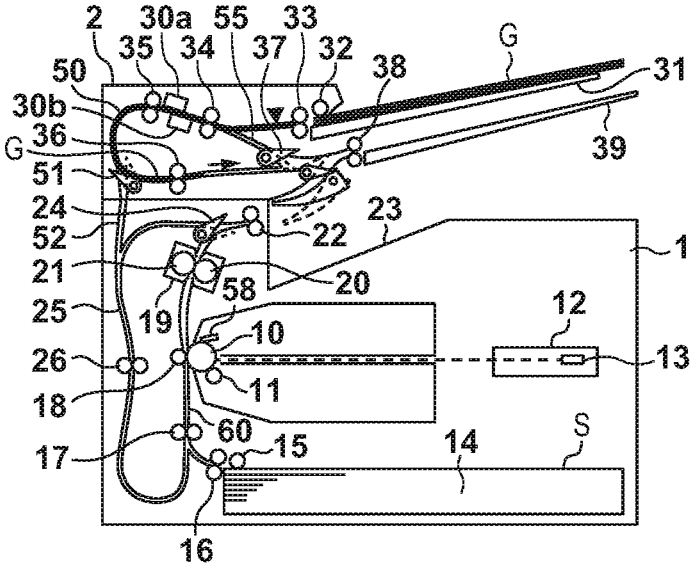
Figure 10C:
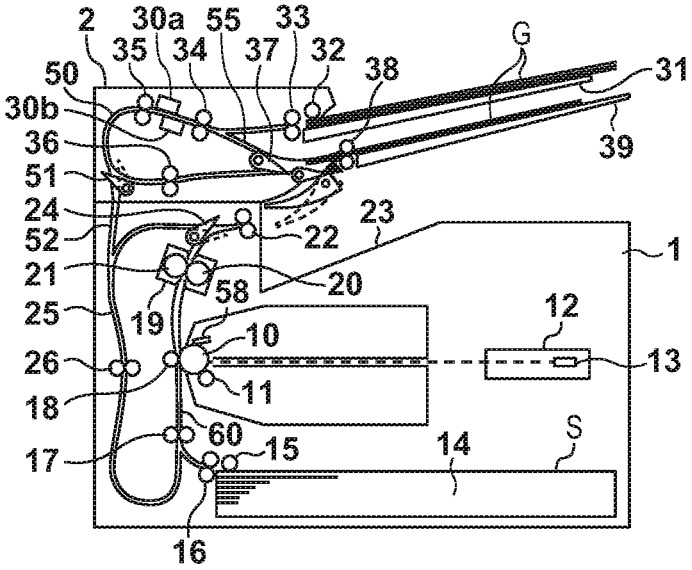

As FIG. 10B illustrates, the conveyance control unit 206 conveys the original G, causes the image sensor 30*a* to read the first side, and causes the image sensor 30*b* to read the second side. Furthermore, as FIG. 10C illustrates, the conveyance control unit 206 guides the original G to the second discharge unit 39 by controlling the flapper 51. The side determination unit 210 performs character recognition of a page number from the read result of the image sensor 30*a* and the read result of the image sensor 30*b*, and determines that the first side is fed facing upward. Furthermore, by applying character recognition to the read result of the image sensor 30*a*, the direction determination unit 211 recognizes that a character is rotated 180 degrees, and determines that the original G is fed from the bottom edge. The side alignment unit 212 determines that an image is to be formed on the second side before the first side from an instruction of the operator and the side that is facing upward of the original G in the second discharge unit 39. Also, the direction determination unit 211 determines which edge out of the top edge and the bottom edge of the second side the nip portion is entered from. In this example, the top edge of the first side and the top edge of the second side are the same. Depending on the double-page spread setting for the original G, there are cases in which the top edge of the first side and the top edge of the second side are opposite edges in the conveyance direction. The direction determination unit 211 determines that the nip portion is entered from the top edge based on the result of the character recognition of the second side. The direction determination unit 211 determines how many degrees to cause the rotation unit 205 to rotate the image in accordance with the edge that enters the nip portion first and the double-page spread setting. If the top edge of the second side enters the nip portion first, the direction determination unit 211 and the rotation unit 205 decide that the rotation angle is 0 degrees. If the bottom edge of the second side enters the nip portion first, the direction determination unit 211 and the rotation unit 205 decide that the rotation angle is 180 degrees. The rotation unit 205 causes the image data for the second side to rotate in accordance with the decided rotation angle.

Figure 11A:
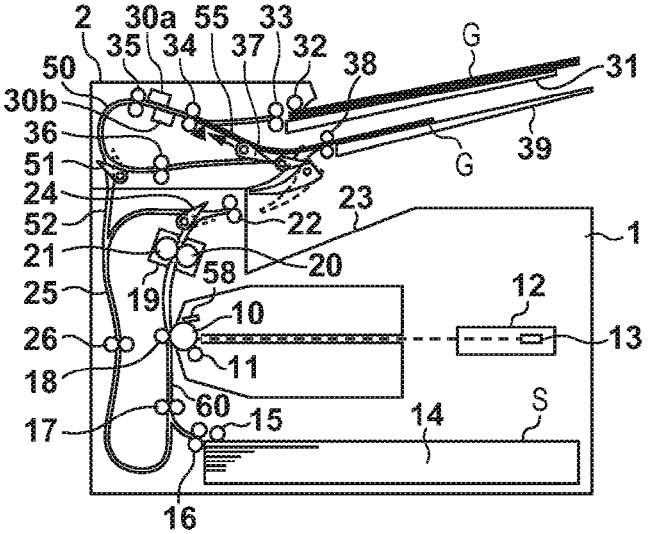
FIGS. 11A to 11C are views illustrating an example of conveying an original.
Figure 11B:
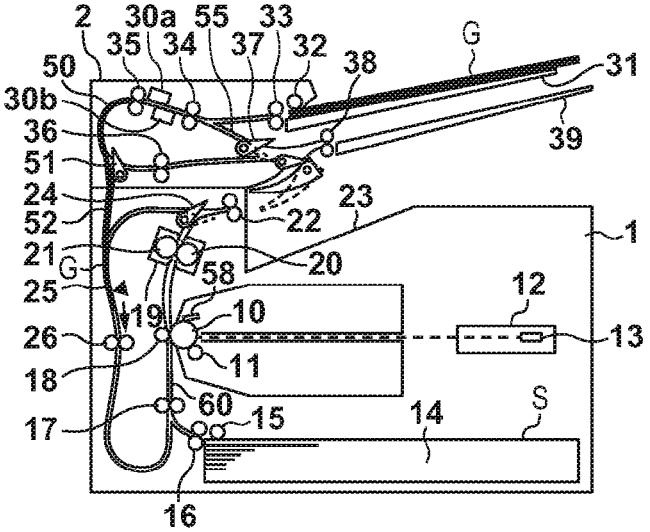
Figure 11C:
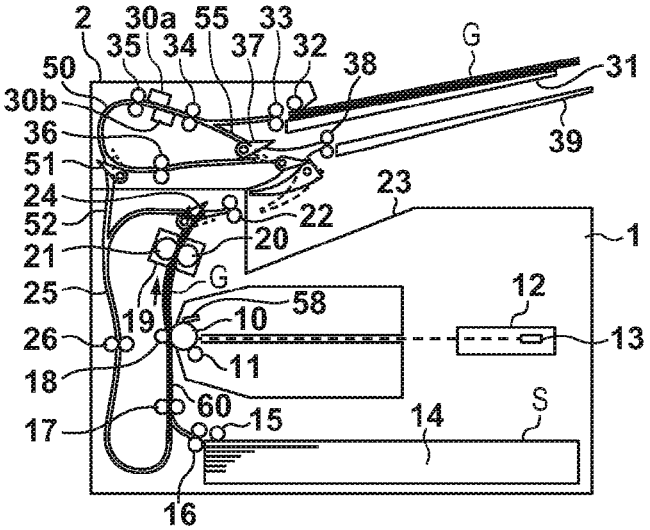

As FIG. 11A illustrates, the conveyance control unit 206 sends the original G from the second discharge unit 39 to the second sub conveyance path 55. As FIG. 11B illustrates, the conveyance control unit 206 guides the original G to the contact path 52 by switching the flapper 51. As FIG. 11C illustrates, the photosensitive drum 10 overwrites an image to the second side (back side) of the original G first. In the left-right double-page spread setting, the top edge of the first side and the top edge of the second side are aligned, but in the top-bottom double-page spread setting the top edge of the first side and the top edge of the second side are opposite. In other words, in FIG. 11C, it is illustrating that the nip portion is entered from the top edge of the second side in the case of the left-right double-page spread setting, and it is illustrating that the nip portion is entered from the bottom edge of the second side in the case of the top-bottom double-page spread setting. In the former, the rotation angle of the image is set to 0 degrees, and in the latter, the rotation angle is set to 180 degrees.

Figure 12A:
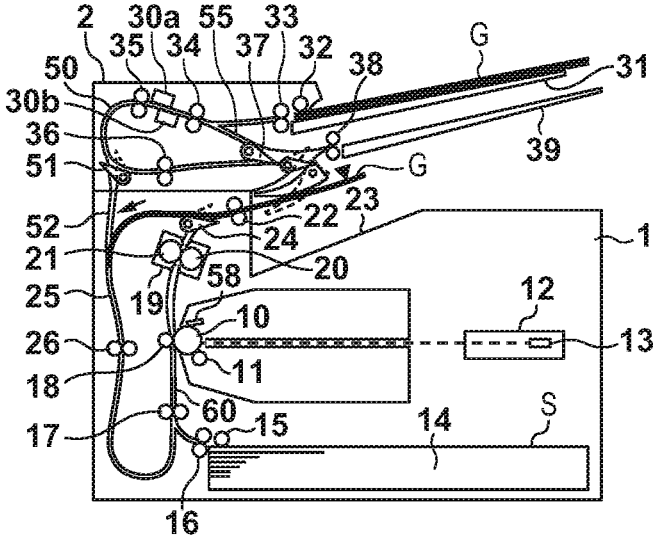
FIGS. 12A to 12C are views illustrating an example of conveying an original.
Figure 12B:
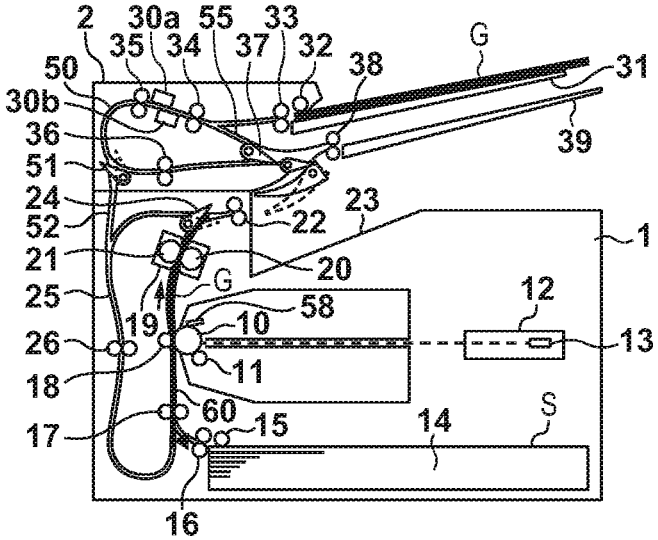

As FIG. 12A illustrates, when the trailing edge of the original G on which the image is formed on the second side reaches the flapper 24, the conveyance control unit 206 switches the flapper 24 and causes the rotation direction of the discharging rollers 22 to reverse. By this, the conveyance direction of the original G is reversed and the front and back of the original G are also reversed, and the original G is guided to the first sub conveyance path 25. As FIG. 12B illustrates, the photosensitive drum 10 overwrites the toner image to the first side of the original G, and the conveyance control unit 206 discharges the original G to the first discharge unit 23. At that time, because the original G passes through the image forming unit such that the bottom edge of the original G becomes the leading edge in the conveyance direction, the direction determination unit 211 and the rotation unit 205 set the rotation angle of the image to 180 degrees. The rotation unit 205 outputs the image data to the exposure control unit 207 after causing it to rotate 180 degrees. The exposure control unit 207 and the optical scanner 12 start formation of a latent image from the bottom edge of the image.

Figure 12C:
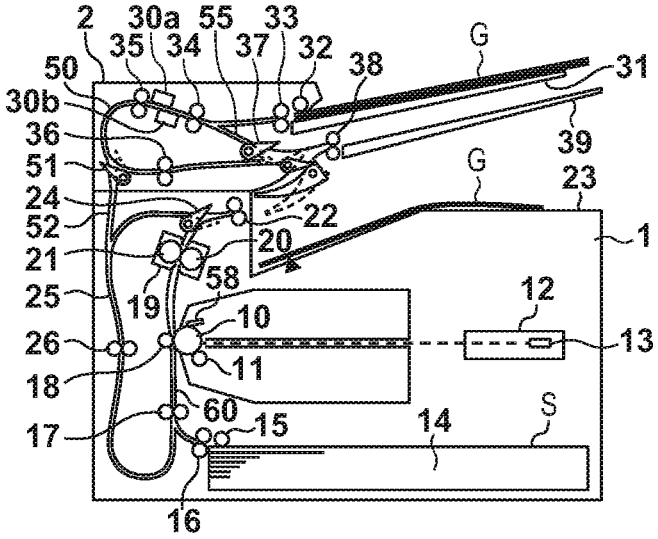

As FIG. 12C illustrates, when overwriting to the first side ends, the conveyance control unit 206 discharges the original G without causing it to pass through the sub conveyance path. In other words, the first side of the original G faces down, and the second side faces up. Because the original G is fed in ascending order of page number in the second feed unit 31, originals G whose page number is smaller are discharged to the first discharge unit 23 first. In other words, the page alignment unit 213 determines that reversal of the front and back of the original G on which images are formed on both sides is unnecessary from the order of page numbers of the original G in the second feed unit 31 and from the fact that the first side of the original G is to be discharged facing downward. The page number of the original G can be obtained by character recognition. In this way, the order of page numbers is maintained even if double-sided image formation is executed on a plurality of double-sided originals.

In the third embodiment, both sides are read concurrently by the two image sensors 30*a* and 30*b*. However, similarly to the first and second embodiments, the third embodiment can be applied to an image forming system 100 which is only equipped with the image sensor 30*a*. As described above, the image sensor 30*a* reads one of the sides by the conveyance steps illustrated in FIG. 10A to FIG. 10C. Furthermore, by executing the conveyance steps of FIG. 5A to FIG. 5B, the image sensor 30*a* reads the other side. By this, the images of both sides can be obtained, and the side determination and the orientation determination can be executed.

As described above, by determining the sides of the original G and causing the image formation sides to be aligned even if images are overwritten to both sides of the original G, an image for the first side is correctly formed on the first side, and an image for the second side is correctly formed on the second side. Also, by determining the orientation of the original G and rotating the image, it becomes possible to form an image with the correct orientation. Furthermore, the page alignment unit 213 executes reversal of the front and back of the original G so that the first side is facing downward by determining the side that faces down in the first discharge unit 23 for the original G to which images are formed on both sides. By this, the page order of the plurality of the original G in the second feed unit 31 is maintained even in the first discharge unit 23.

Fourth Embodiment

Figure 13A:
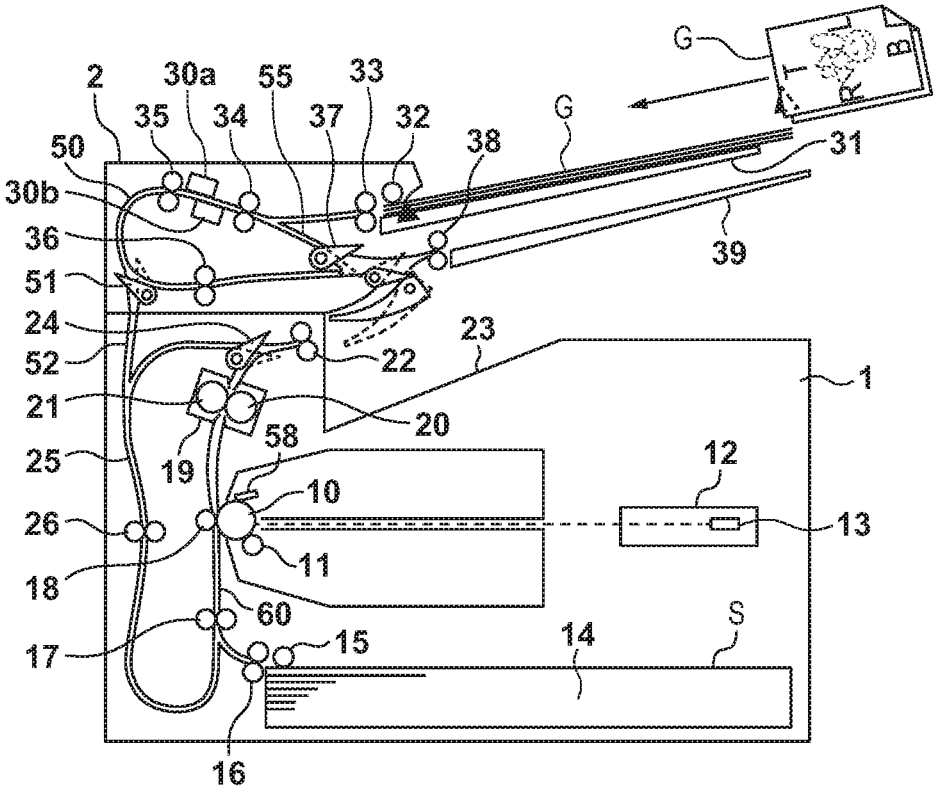
FIGS. 13A to 13C are views illustrating an example of conveying an original.

In the fourth embodiment, same side printing is executed from a final page for a plurality of single-sided originals. Same side printing means forming another image by overwriting to a side on which an image is already formed in the original G. In this way, the fourth embodiment is merely a variation of the first embodiment. FIG. 13A to FIG. 15C illustrate steps for conveying to an original G in the fourth embodiment. In the fourth embodiment, as FIG. 13A illustrates, that the first side of the single-sided original is placed on the second feed unit 31 facing downward (opposite placement) differs from the first embodiment. In other words, images are formed by feeding in order from the final page among the plurality of the original G. The ▼ mark is as described previously.

As FIG. 13A illustrates, a plurality of the original G are stacked from bottom to top. The page number of the original G that is placed lowest is the smallest, and the page number of the original G that is placed highest is the largest. In other words, the plurality of the original G are stacked in the second feed unit 31 such that the position of the original G and the page number are inversely proportional. Also, the top edges of the plurality of the original G face in the conveyance direction. In other words, the top edge of the original G is fed from the second feed unit 31 as the leading edge. The acceptance unit 203 accepts image data and an instruction to print an image on a first side of a single-sided original through the operation unit 201, the communication unit 202, or the like.

Figure 13B:
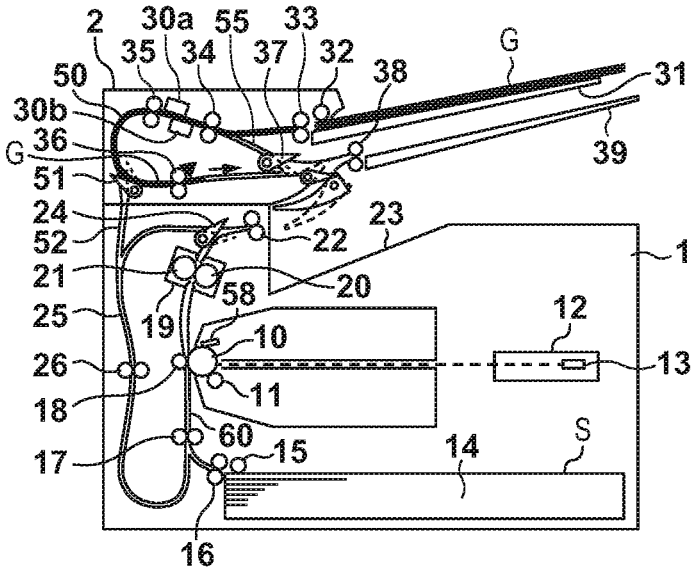
Figure 13C:
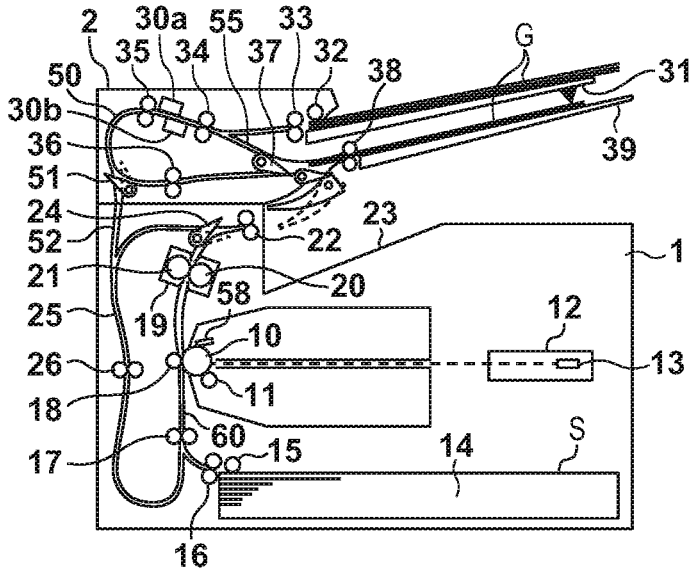

As FIG. 13B illustrates, the conveyance control unit 206 feeds the final page original G by causing the paper feed roller 32 or the like to rotate. The image sensor 30*a* reads the second side, and the image sensor 30*b* reads the first side. As FIG. 13C illustrates, the conveyance control unit 206 guides the original G to the second discharge unit 39 by controlling the flapper 51 to a position indicated by a solid line. The side determination unit 210 determines that the second side is fed facing upward (the first side faces down) because the read result of the image sensor 30*a* is a read result corresponding to a blank sheet, and an image is included in the read result of the image sensor 30*b*. If the first side is fed facing downward, the first side faces upward in the second discharge unit 39. As described above, the side facing upward in the second discharge unit 39 is aligned with the side facing the photosensitive drum 10. The side alignment unit 212 determines that further reversal of front and back in the image reading apparatus 2 is unnecessary based on a first side image forming instruction and that the side facing upward in the second discharge unit 39 is the first side. The direction determination unit 211 determines that the original G is fed with the top edge of the first side as the head (the leading edge) by executing character recognition on the result of reading the first side. Accordingly, the direction determination unit 211 determines that the top edge of the first side is the trailing edge (the bottom edge is the leading edge), and is conveyed from the second discharge unit 39 to the contact path 52, and sets 180 degrees as the rotation angle in the rotation unit 205. By this, the toner image is formed from the bottom edge first at the photosensitive drum 10.

Figure 14A:
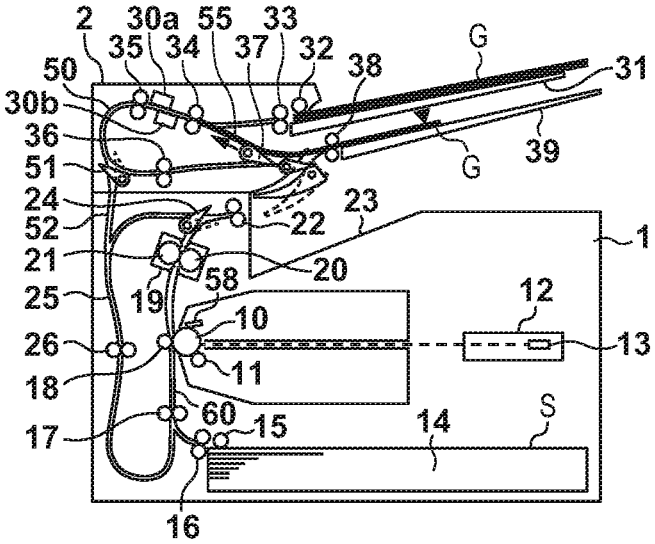
FIGS. 14A to 14C are views illustrating an example of conveying an original.
Figure 14B:
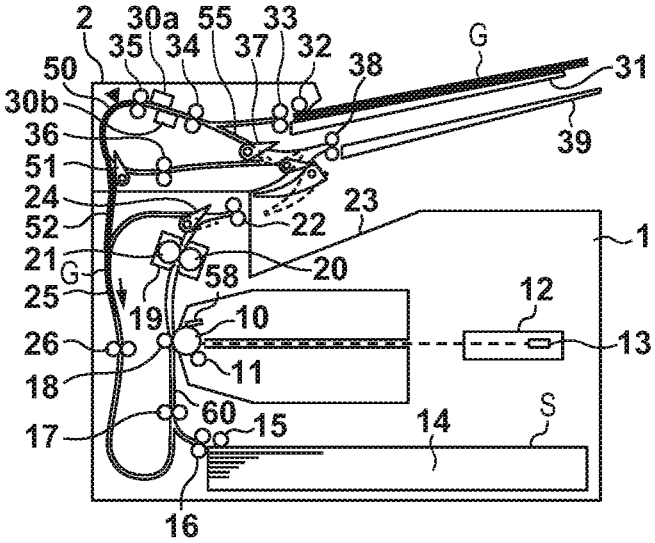

As FIG. 14A illustrates, the conveyance control unit 206 conveys the original G from the second discharge unit 39. As FIG. 14B illustrates, the conveyance control unit 206 guides the original G to the contact path 52 by moving the flapper 51 to a position indicated by a broken line.

Figure 14C:
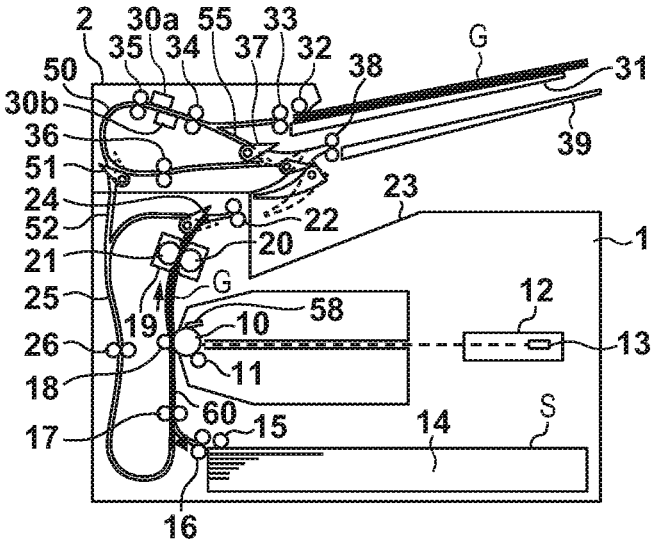
Figure 15A:
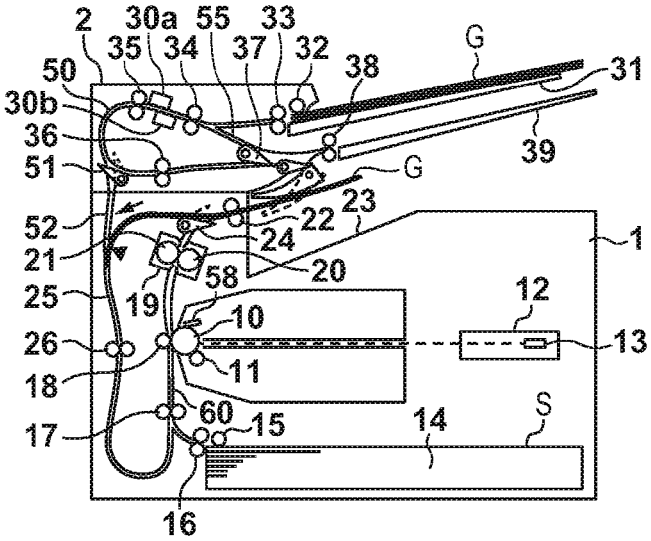
FIGS. 15A to 15C are views illustrating an example of conveying an original.
Figure 15B:
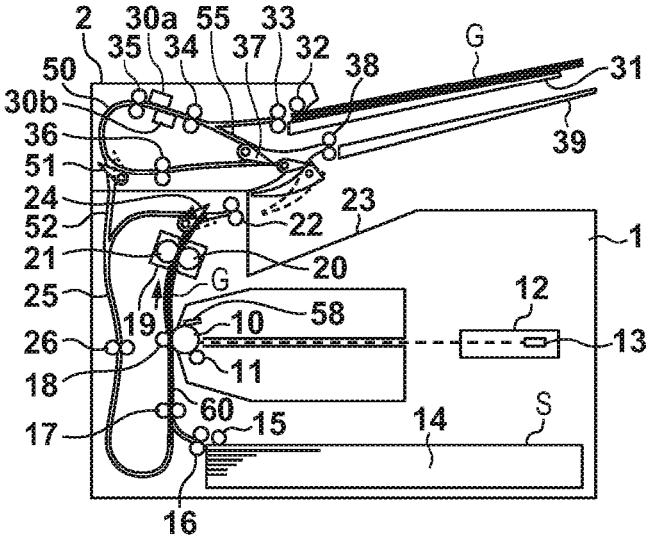
Figure 15C:
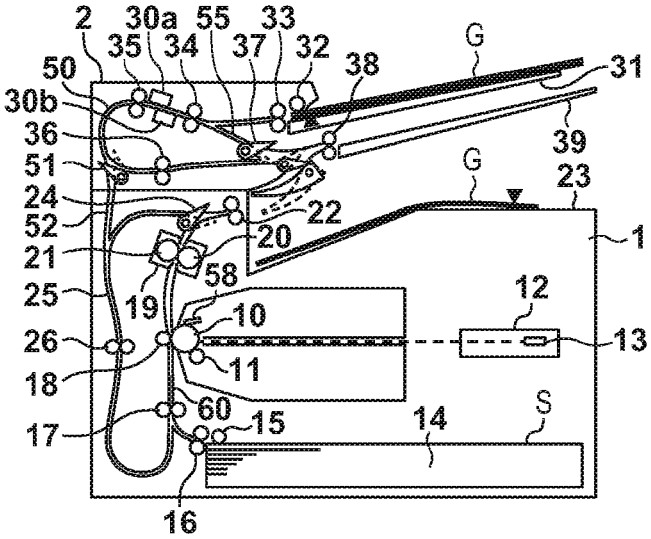

As FIG. 14C illustrates, the nip portion is entered from the bottom edge of the original G. Because the toner image is formed from the bottom edge in the photosensitive drum 10, transfer is performed such that the bottom edge of the original G and the bottom edge of the toner image are aligned. Here, the final page original G is discharged to the first discharge unit 23 so as to become the lowest. The page alignment unit 213 decides to discharge the original G face up based on the fact that the plurality of the original G are fed from the final page and that an image is formed on the first side of the originals G. By this, the page order of the originals G is maintained. The page alignment unit 213 determines that it is necessary to cause the front and back of the original G to be reversed one time to discharge the first side of the original G facing upward because an image is formed on the first side. The page alignment unit 213 instructs the conveyance control unit 206 so that the front and back of the original G are caused to be reversed one time. As FIG. 15A illustrates, when the trailing edge of the original G reaches the flapper 24, the conveyance control unit 206 switches the flapper 24 and causes the rotation direction of the discharging rollers 22 to reverse. By this, the original G is guided to the first sub conveyance path 25. As FIG. 15B illustrates, the original G is conveyed from the first sub conveyance path 25 to the first main conveyance path 60. As FIG. 15C illustrates, the original G is discharged to the first discharge unit 23 so that the first side faces upward.

If only one original G is placed on the second feed unit 31, it is not necessary to worry about the page order of the original G. In such a case, the page alignment unit 213 determines that it is unnecessary to reverse the front and back of the original G. Note that it is possible to determine whether or not there is only one of the original G based on information inputted from the operation unit 201 and information from the sheet sensor arranged in the second feed unit 31.

As described above, it is possible to cause the sides and the orientation of the original G and the sides and the orientation of the image to be aligned in the fourth embodiment. Also, the page order of the originals G in the image forming apparatus 1 is aligned.

[Flowchart]

Figure 16:
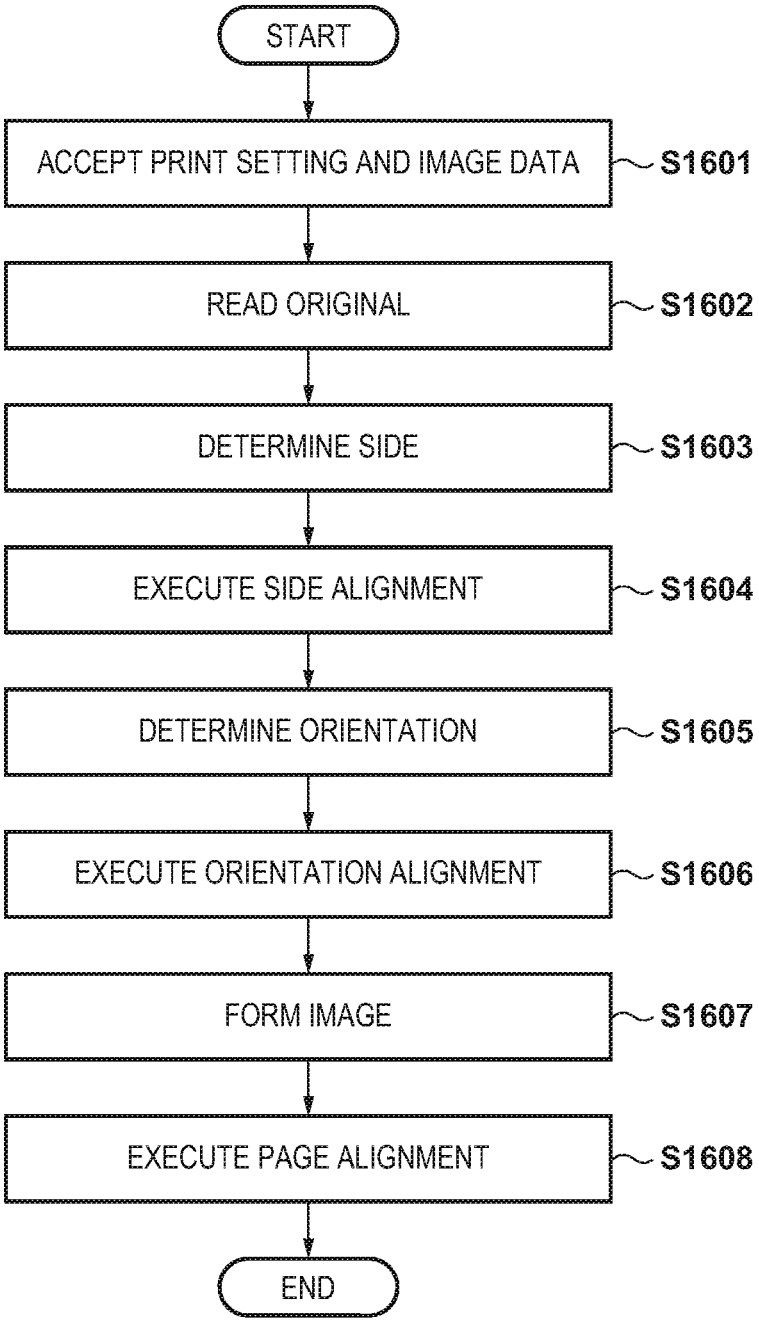
FIG. 16 is a flowchart illustrating conveyance control.

Conveyance control in embodiments is summarized while referring to the flowchart illustrated in FIG. 16. In step S1601, the acceptance unit 203 accepts print settings and image data through the operation unit 201, the communication unit 202, or the like. Note that an interface for connecting a memory card in which an image stored to the operation unit 201, an interface such as universal serial bus, or the like, may be included. It is sufficient if these interfaces are connected to the control unit 200, and they may be implemented in the communication unit 202. In print settings, same side printing to a single-sided original (first and fourth embodiments), opposite side printing to a single-sided original (second embodiment), and double-sided printing to a double-sided original are included. Opposite side printing may also be referred to as back side printing.

In step S1602, the control unit 200 causes the conveyance control unit 206 to start feeding and conveying the original G, and reads both sides of the original G using the image sensors 30*a* and 30*b*. In step S1603, the side determination unit 210 determines which of the sides out of the first side and the second side faces upward when the original G is fed based on the read result of the image sensor 30*a* and the read result of the image sensor 30*b*. As described above, the existence or absence of an image or a page number included in the read result is used in the determination.

In step S1604, the side alignment unit 212 executes the side alignment based on the result of the determination by the side determination unit 210 and the designation of the image formation side in the print setting. Side alignment means causing the side on which the image is to be formed out of the first side and the second side of the original G to face the photosensitive drum 10. In the present embodiment, the side alignment is realized by causing the conveyance direction of the original G (front/back) to be reversed an odd number of times (at least one time) or an even number of times (at least 0 times) in the image reading apparatus 2.

FIG. 17A is a table that indicates the number of times of reversal corresponding to combinations of the type of the original G, the side facing upward, and the print setting. This table is stored in a storage apparatus that the control unit 200 is equipped with, for example. Normal placement indicates that a first side on which an image is formed is placed facing upward, as FIG. 4A and the like illustrate. Opposite placement indicates that a first side on which an image is formed is placed facing downward, as FIG. 13A or the like illustrates. Note that reversal processing in the image reading apparatus 2 is reversal processing for side alignment. The number of times of reversal in the image forming apparatus 1 is for reversal processing for double-sided printing and page alignment. In same side printing to single-sided originals in the case of normal placement as described in the first embodiment, the number of times of reversal in the image reading apparatus 2 need only be an even number of times, and is set to zero times or two times in particular. Note that because the original G passes through the second sub conveyance path 55 one time when reversal is executed one time, the number of times of reversal is the same as the number of times the original G passes through the second sub conveyance path 55. The conveyance control unit 206 sends originals G to the contact path 52 by causing the front and back of originals G to be reversed by the number of times of reversal instructed by the side alignment unit 212.

In step S1605, the direction determination unit 211 determines the orientation of the original G fed from the second feed unit 31. In other words, it is determined whether or not the top edge of the original G is facing in the conveyance direction (leading edge). A character included in a result of reading the original G (image data) may be recognized, and the orientation may be identified from the rotation angle of the character of the original G when character recognition succeeds.

In step S1606, the rotation unit 205 executes orientation alignment. The rotation unit 205 decides the rotation angle of the image formed by overwriting to the original G based on the result of determining the orientation by the direction determination unit 211, and causes image data to rotate in accordance with the decided rotation angle. Note that the rotation unit 205 may also be referred to as an orientation alignment unit. Also, a function for deciding the rotation angle may be separated from the rotation unit 205 and implemented in the control unit 200 as an orientation alignment unit.

FIG. 17B is a table that indicates the rotation angle corresponding to combinations of the type of the original G, the print setting, the orientation of the original G, and the double-page spread setting. This table is also stored in a storage apparatus that the control unit 200 is equipped with, for example. The rotation unit 205 may, in addition to the result of orientation determination by the direction determination unit 211, decide a rotation angle corresponding to a combination of the type of the original G, the print setting, and the double-page spread setting by obtaining it from the table.

In step S1607, the control unit 200 forms a toner image on the image formation side of the original G by controlling the image forming apparatus 1. The control unit 200 supplies image data outputted from the image processing unit 204 to the exposure control unit 207. The exposure control unit 207 causes the photosensitive drum 10 to form an electrostatic latent image by controlling the optical scanner 12. The control unit 200 generates the toner image by developing the electrostatic latent image with toner by controlling the developing roller 11. The control unit 200 controls the transfer unit 18 and thereby the toner image is transferred to the original G from the photosensitive drum 10. The control unit 200 causes a toner image to be fixed to the original G by applying heat and pressure by controlling the fixing unit 19.

In step S1608, the page alignment unit 213 executes page alignment. As described above, page alignment means processing for causing the page order of the plurality of the original G that are discharged to the first discharge unit 23 and stacked to be aligned with respect to the page order of the plurality of the original G placed on the second feed unit 31. In other words, by the page alignment, the page number of the plurality of the original G discharged to the first discharge unit 23 and stacked is kept in the correct order. The page alignment unit 213 decides the number of times of reversal in the image forming apparatus 1 corresponding to the type and the print setting of the original G by referring to the table illustrated in FIG. 17A. As described above, the front and back of the original G are reversed by causing the conveyance direction of the original G to be reversed. The number of times of reversal is the same as the number of times that the original G passes through a conveyance section from a position at which the flapper 24 is installed in the first sub conveyance path 25 and a position at which the contact path 52 is joined.

The control unit 200 repeatedly executes each step from step S1601 to step S1608 on all of the originals G placed in the second feed unit 31. Note that an execution order of the steps can be switched as necessary as long as side alignment, orientation alignment, and page alignment are executed correctly.

[Conclusion]

As described using FIG. 1, the image forming apparatus 1 has the first main conveyance path 60 and the first sub conveyance path 25. The first main conveyance path 60 conveys the recording material S to the first discharge unit 23 from the first feeding unit 14 which is a storage unit of the recording material S. The photosensitive drum 10 which functions as an image forming unit for forming an image on the recording material S is arranged in the first main conveyance path 60. In the ink-jet printing method, an ink head that dispenses ink functions as an image forming unit. The discharging rollers 22 function as a first reversing unit for reversing the side that faces the image forming unit by reversing the conveyance direction of the recording material S that has been conveyed through the first main conveyance path 60. The first sub conveyance path 25 conveys the recording material S whose conveyance direction is reversed by the discharging rollers 22 to the first main conveyance path 60. The first sub conveyance path 25 may be referred to as a double-sided conveyance path because the recording material S passes through it at a time of double-sided printing.

The image reading apparatus 2 has the second main conveyance path 50 and the second sub conveyance path 55. The second main conveyance path 50 conveys the original G which is fed from the second feed unit 31. The image sensors 30*a* and 30*b* which function as reading units for reading the original G are arranged in the second main conveyance path 50. The discharging rollers 38 function as a second reversing unit that reverses the conveyance direction of the original G. The second sub conveyance path 55 conveys the original G whose conveyance direction is reversed by the discharging rollers 38 to the second main conveyance path 50.

The image forming system 100 also has the contact path 52 which functions as a connecting conveyance path. The contact path 52 branches from the second main conveyance path 50 of the image reading apparatus 2, joins the first sub conveyance path 25 of the image forming apparatus 1, and conveys the original G from the image reading apparatus 2 to the image forming apparatus 1 as the recording material S. The side determination unit 210 is an example of a first determination unit that determines which of the first side and the second side of the original G is fed facing upward based on a result of reading the original G by the reading unit. Similarly, the side determination unit 210 may function as a determination unit that determines the first side and the second side of the original G based on the result of reading the original G by the reading unit. The acceptance unit 203 accepts the designation information that designates which of the first side and the second side of the original G is an image formation side. The designation information is a kind of print setting. When the first side of the original G is designated as the image formation side, the side alignment unit 212 and the conveyance control unit 206 may send the original G to the contact path 52 via the second main conveyance path 50 and the second sub conveyance path 55 in accordance with the determination result so that the first side of the original G becomes the side that faces the image forming unit. By this, a burden on the operator when forming an image by overwriting to an original is reduced. Note that when the first side of the original G is designated as the image formation side, the conveyance control unit 206 may control conveyance of the original G in accordance with the determination result of the determination unit so that the first side of the original G becomes the side that faces the image forming unit. Also, when the second side of the original G is designated as the image formation side, the conveyance control unit 206 controls conveyance of the original G so that the second side becomes the side that faces the image forming unit.

Note that the total distance of the second main conveyance path 50 and the second sub conveyance path 55 is shorter than the total distance of the first main conveyance path 60 and the first sub conveyance path 25, as is clear from FIG. 1. In other words, it becomes possible to shorten the original G conveyance time in the present embodiment compared to the case where side alignment is performed by conveying the original G to circulate in the image forming apparatus 1.

As described above, the direction determination unit 211 functions as a second determination unit that determines which of the visual top edge and bottom edge of the original G is fed from the second feed unit 31 as the leading edge in the conveyance direction. The rotation unit 205 causes an image formed by an image forming unit to rotate in accordance with a determination result of the direction determination unit 211 so as to align the top edge of the original G and the top edge of an image formed by the image forming unit. Because the image is formed in advance on the original G, the visual top edge and bottom edge are present on the original G. Accordingly, it becomes possible to form an image in the correct orientation in relation to the original G by causing the image to rotate in accordance with which of the top edge and the bottom edge is fed facing the conveyance direction. Note that when the original G is fed in a horizontal direction, the left edge or the right edge becomes the leading edge. The rotation angle in such a case is as described already 90 degrees or 270 degrees. Note that the edge that is the leading edge is switched in accordance with whether the number of times of reversal in the image reading apparatus 2 is an odd number or an even number. Accordingly, the number of times of reversal may be considered. In other words, it may be determined whether the leading edge of the original G when the contact path 52 is passed through is the top edge or the bottom edge. For example, if the top edge of the original G is fed as the leading edge, the bottom edge is the leading edge in the contact path 52 if the number of times of reversal is an odd number (example: one time). If the number of times of reversal is an even number (example: zero times or two times), the top edge becomes the leading edge in the contact path 52. In opposite side printing (back side printing) and double-sided printing, a double-page spread setting can also be considered. Here, it becomes possible to also cause the visual orientation of the original G and the visual orientation of the image to be aligned correctly.

The side determination unit 210 determines the side on which an image is already formed in the original G to be the first side based on the result of reading the original G by the reading unit. In the case of a single-sided original, an image is formed on the first side, and no image is formed on the second side. Accordingly, it is possible for the side determination unit 210 to correctly determine the side by using this feature. The reading unit may have an image sensor 30*a* that functions as a first image sensor and an image sensor 30*b* that functions as a second image sensor. As FIG. 1 and the like illustrate, the image sensor 30*a* is arranged on the outer circumference side of the second main conveyance path 50. The image sensor 30*b* is arranged on the inner circumference side of the second main conveyance path 50. Accordingly, the side determination unit 210 determines that the original G is fed with the first side facing upward when the image of the original G is detected by the image sensor 30*a*.

Configuration may be taken so that only one image sensor is arranged in the reading unit. As described above, the conveyance control unit 206 conveys the original G to the second main conveyance path 50 again via the second sub conveyance path 55 after causing the conveyance direction of the original G to reverse by the discharging rollers 38 when one side of the original G is read by the image sensor 30*a*. By this the image sensor 30*a* is enabled to read the other side of the original G. As described above, the original G is always sent to the image sensor 30*a* via the second sub conveyance path 55 if caused to wait at least one time in the discharging rollers 38 in the image reading apparatus 2. In other words, even if only one image sensor is arranged, unnecessary conveyance time tends not to be spent. The side determination unit 210 determines that the first side of the original G is fed facing upward when an image is detected when one side of the original G is read by the one image sensor 30*a*. The side determination unit 210 determines that the second side is fed facing upward when an image is detected when the other side of the original G is read by the one image sensor 30*a*. In this way, it is possible to determine the side on which the original G is fed with efficiency by using the image sensor 30*a* arranged on the outer circumference side of the second main conveyance path 50. Note that if opposite placement as FIG. 13A illustrates is the basic placement method, it becomes possible to execute a determination of the side efficiently by arranging the image sensor 30*b* on the inner circumference side of the second main conveyance path 50.

There are cases in which first side of the original G is fed facing upward and the image is formed only on the first side in the image forming apparatus 1. In such a case, the conveyance control unit 206 sends the original G to the contact path 52 after conveying the original G by the second main conveyance path 50 and the second sub conveyance path 55 so that the number of times of reversal in the discharging rollers 38 becomes an even number. By this, it becomes possible to form an image and discharge the original G without causing the original G to be reversed in the image forming apparatus 1. In such a case, the conveyance control unit 206 discharges the original G after conveying the original G so that the number of times of reversal in the discharging rollers 22 which is the first reversing unit becomes an even number (zero times in same side printing to a single-sided original). By this, it is possible to convey the original G efficiently and page alignment according to face down discharge is realized.

As described in relation to the fourth embodiment, there are cases in which the first side of the original G is fed facing downward and an image is formed on only the first side. The conveyance control unit 206 sends the original G to the contact path 52 after conveying the original G by the second main conveyance path 50 and the second sub conveyance path 55 so that the number of times of reversal in the discharging rollers 38 which is the second reversing unit becomes an odd number (at least one time). By this, the first side faces the photosensitive drum 10 which is the image forming unit, and it is possible to reduce the conveyance time for side alignment in the image forming apparatus 1.

As described in relation to the second embodiment, there are cases in which the first side of the original G is fed facing upward and an image is formed on only the second side. The conveyance control unit 206 sends the original G to the contact path 52 after conveying the original G by the second main conveyance path 50 and the second sub conveyance path 55 so that the number of times of reversal in the discharging rollers 38 becomes an odd number. By this, the second side faces the photosensitive drum 10, and it is possible to reduce the conveyance time for side alignment in the image forming apparatus 1. As described in regards to the second embodiment, the conveyance control unit 206 discharges the original G after conveying the original G so that the number of times of reversal of the conveyance direction of the original G in the discharging rollers 22 becomes an odd number. By this, it becomes possible to correctly align the page order of an opposite placement plurality of the original G in the first discharge unit 23.

As described in relation to the third embodiment, there are cases in which double-sided printing, in which images are formed on each of the first side and the second side of the original G, is designated by the operator. After conveying the original G through the second main conveyance path 50 and the second sub conveyance path 55 an odd number of times, the conveyance control unit 206 sends the original G to the contact path 52. By this, the side alignment is realized. The image forming apparatus 1 forms an image on the side that was facing upward after forming an image on the side that was facing downward first out of the first side and the second side of the original G, when the original G was fed from the second feed unit 31. By this, the conveyance time for side alignment is reduced. Also, it becomes possible to correctly align the page order of the plurality of the original G in the first discharge unit 23 because it is possible to realize a face down discharge for the first side. In other words, the conveyance control unit 206 over an odd number of times conveys the original G through the first main conveyance path 60 and the first sub conveyance path 25 and discharges it. In other words, the conveyance time in the image forming apparatus 1 does not increase because the number of times of reversal of the original G in the image forming apparatus 1 need only be one time for double-sided printing.

As described using FIG. 17B, it becomes possible to cause the orientation of the image to be correctly aligned in relation to the orientation of the original G for double-sided printing to a double-sided original. The direction determination unit 211 determines which of the visual top edge and bottom edge of the original G is fed from the second feed unit 31 as the leading edge in the conveyance direction. The rotation unit 205 decides the rotation angle of the image so that the top edge of the original G and the top edge of the image formed by the image forming unit are aligned. For example, the rotation unit 205 causes the image formed on the first side of the original G and the image formed on the second side by the image forming unit to rotate in accordance with the result of the determination of the direction determination unit 211 and the original G double-page spread setting.

Incidentally, the image forming apparatus 1 may contain the image reading function of the image reading apparatus 2. The second feed unit 31 is an example of a feeding unit for feeding the original G. The image sensors 30*a* and 30*b* are an example of a reading unit that reads the original G which is fed from the feeding unit. The second main conveyance path 50 and the second sub conveyance path 55 are an example of a first conveyance path that has a reversal function for reversing the front and back of the original G, and that conveys the original G. The first main conveyance path 60 and the first sub conveyance path 25 are an example of a second conveyance path that has a reversal function for reversing the front and back of the original G or a recording material, and that conveys the original G or a recording material. The contact path 52 is an example of a connecting conveyance path that branches from the first conveyance path, and joins the second conveyance path, and conveys the original G which has been conveyed through at least a portion of a conveyance section (the second main conveyance path 50) in the first conveyance path to the second conveyance path. The photosensitive drum 10 is an example of an image forming unit that forms an image on an original that has been conveyed through at least a portion of the conveyance section (the first main conveyance path 60) of the second conveyance path. The conveyance control unit 206 determines which of the first side and the second side of the original G is fed facing upward based on a result of reading the original G by the reading unit. Note that when the first side of the original G is designated as the image formation side, the conveyance control unit 206 may feed the original to the image forming unit after conveying of the original G through the first conveyance path or the second conveyance path in accordance with the determination result of the side determination unit 210 so that the first side of the original G becomes the side that faces the image forming unit. By this, the burden on the operator when forming an image by overwriting to an original is reduced.

According to FIG. 1, the total distance of the first conveyance path is shorter than the total distance of the second conveyance path. In such a case, the conveyance control unit 206 may cause the first side of the original G to face the image forming unit by causing the front and back of the original to be reversed in the first conveyance path. In other words, the conveyance time is shortened because the front and back of the original G are reversed in a conveyance path in which the conveyance time is shorter.

Unlike FIG. 1, the total distance of the first conveyance path arranged in the image reading apparatus 2 is longer than the total distance of the second conveyance path arranged in the image forming apparatus 1. In such a case, the conveyance control unit 206 may cause the first side of the original G to face the image forming unit by causing the front and back of the original to be reversed in the second conveyance path of the image forming apparatus 1. In other words, the conveyance time is shortened because the front and back of the original G are reversed in a conveyance path in which the conveyance time is shorter.

The conveyance control unit 206 has a distance determination unit that determines which of the total distance of the first conveyance path and the total distance of the second conveyance path is shorter. Also, the conveyance control unit 206 causes the front and back of the original to be reversed in the reversing unit arranged on the conveyance path whose distance is relatively shorter out of the first conveyance path and the second conveyance path. By this, the conveyance time may be shortened.

Incidentally, the image forming apparatus 1 may contain the image reading function of the image reading apparatus 2. For example, the image reading apparatus 2 may be omitted, and the image sensors 30*a* and 30*b* may be arranged in the first main conveyance path 60. For example, the image sensors 30*a* and 30*b* are arranged in the conveyance section from the paper feed roller 15 to the photosensitive drum 10. In such a case, the first feeding unit 14 is an example of a feeding unit for feeding the original G. The first feeding unit 14 may be a paper feed cassette and may be a manual feed tray. The image sensors 30*a* and 30*b* are an example of a reading unit that reads the original G which is fed from the first feeding unit 14. The first main conveyance path 60 is an example of a main conveyance path that conveys the original G which is fed from the first feeding unit 14. The photosensitive drum 10 is an example of an image forming unit that forms an image on the original G which has been conveyed through the first main conveyance path 60. The first sub conveyance path 25 is an example of a sub conveyance path that branches from the main conveyance path on the downstream side from the image forming unit in the conveyance direction of the original G and joins the main conveyance path on the upstream side from the image forming unit in the conveyance direction of the original G. The first sub conveyance path 25 is a sub conveyance path having a reversing unit that causes the front and back of an original to be reversed. The side determination unit 210 determines which of the first side and the second side of the original G is fed facing upward based on a result of reading the original G by the reading unit. Also, when the first side of the original G is designated as the image formation side, the conveyance control unit 206 executes conveyance control so that the first side of the original G becomes the side that faces the image forming unit. For example, the conveyance control unit 206, in accordance with the determination result of the side determination unit 210, conveys only through the main conveyance path or conveys through the main conveyance path and the sub conveyance path, and then sends the original to the image forming unit. By this, the burden on the operator when forming an image by overwriting to an original is reduced.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-085426, filed Apr. 21, 2016, which is hereby incorporated by reference herein in its entirety.

What is claimed is:

1. An image forming system including an image forming apparatus for forming an image on a recording material and an image reading apparatus for reading an original, wherein the image forming apparatus comprises:

a first main conveyance path configured to convey a recording material from a storage unit to a discharge unit;

an image forming unit arranged on the first main conveyance path and configured to form an image on the recording material;

a first reversing unit configured to reverse a side of the recording material that faces the image forming unit by reversing a conveyance direction of the recording material after the recording material is conveyed through the first main conveyance path; and a first sub conveyance path configured to convey the recording material after the conveyance direction of the recording material is reversed by the first reversing unit to the first main conveyance path, wherein the image reading apparatus comprises:

a second main conveyance path configured to convey an original fed from a feeding unit;

a reading unit arranged on the second main conveyance path and configured to read the original;

a second reversing unit configured to reverse a conveyance direction of the original; and a second sub conveyance path configured to convey the original after its conveyance direction is reversed by the second reversing unit to the second main conveyance path, and wherein the image forming system further comprises:

a connecting conveyance path that branches from the second main conveyance path of the image reading apparatus and joins the first sub conveyance path of the image forming apparatus, and is configured to convey the original from the image reading apparatus to the image forming apparatus;

a first determination unit configured to determine a first side and a second side of the original based on a result of reading the original by the reading unit;

an acceptance unit configured to accept designation information that designates which of the first side and the second side of the original is to be an image formation side; and a conveyance control unit configured to control conveyance of the original in accordance with a result of the determination of the first determination unit so that the first side becomes a side that faces the image forming unit if the first side of the original is designated as the image formation side or so that the second side becomes the side that faces the image forming unit if the second side of the original is designated as the image formation side.

2. The image forming system according to claim 1, wherein the conveyance control unit is further configured to, in accordance with the result of the determination of the first determination unit, control so that the original is conveyed to the connecting conveyance path after the original is conveyed through the second main conveyance path and the second sub conveyance path of the image reading apparatus.

3. The image forming system according to claim 1, further comprising:

a second determination unit configured to determine which of a visual top edge and bottom edge of the original is fed from the feeding unit as a leading edge in the conveyance direction; and a rotation unit configured to cause an image formed by an image forming unit to rotate in accordance with a result of the determination of the second determination unit so as to align a top edge of the original and a top edge of an image formed by the image forming unit.

4. The image forming system according to claim 1, wherein the first determination unit is further configured to determine a side on which an image is formed already on the original to be the first side based on a result of the reading of the original by the reading unit.

5. The image forming system according to claim 4, wherein the reading unit has a first image sensor arranged on an outer circumference side of the second main conveyance path of the image reading apparatus and a second image sensor arranged on an inner circumference side of the second main conveyance path, and the first determination unit is further configured to determine that the original is fed with the first side facing upward when an image of the original is detected by the first image sensor.

6. The image forming system according to claim 4, wherein the reading unit has an image sensor arranged on the second main conveyance path of the image reading apparatus, and wherein by the conveyance control unit again conveying the original to the second main conveyance path via the second sub conveyance path after causing the conveyance direction of the original to reverse by the second reversing unit when one side of the original is read by the image sensor, the image sensor reads the other side of the original.

7. The image forming system according to claim 6, wherein the first determination unit is further configured to determine that the first side of the original is fed facing upward when an image is detected when one side of the original is read by the image sensor, and determine that the second side is fed facing upward when an image is detected when the other side of the original is read by the image sensor.

8. The image forming system according to claim 1, wherein the conveyance control unit is further configured to, if the first side of the original is fed facing upward and an image is to be formed on the first side only, feed the original to the connecting conveyance path after conveying the original in the second main conveyance path and the second sub conveyance path so that a number of times of reversal of the conveyance direction of the original in the second reversing unit becomes an even number.

9. The image forming system according to claim 8, wherein the conveyance control unit is further configured to discharge the original after conveying the original so that the number of times of reversal of the conveyance direction of the original in the first reversing unit becomes an even number.

10. The image forming system according to claim 1, wherein the conveyance control unit is further configured to, if the first side of the original is fed facing downward and an image is to be formed on the first side only, feed the original to the connecting conveyance path after conveying the original in the second main conveyance path and the second sub conveyance path so that a number of times of reversal of the conveyance direction of the original in the second reversing unit becomes an odd number.

11. The image forming system according to claim 10, wherein the conveyance control unit is further configured to discharge the original after conveying the original so that the number of times of reversal of the conveyance direction of the original in the first reversing unit becomes an odd number.

12. The image forming system according to claim 1, wherein the conveyance control unit is further configured to, if the first side of the original is fed facing upward and an image is to be formed on the second side only, feed the original to the connecting conveyance path after conveying the original in the second main conveyance path and the second sub conveyance path so that a number of times of reversal of the conveyance direction of the original in the second reversing unit becomes an odd number.

13. The image forming system according to claim 1, wherein the conveyance control unit is further configured to send the original to the connecting conveyance path after conveying the original through the second main conveyance path and the second sub conveyance path an odd number of times when double-sided printing in which images are formed on both the first side and the second side of the original is designated, and the image forming unit is further configured to form an image on the side that was facing upward after forming an image on the side that was facing downward first out of the first side and the second side of the original, when the original was fed from the feeding unit.

14. The image forming system according to claim 13, further comprising:

a second determination unit configured to determine which of a visual top edge and bottom edge of the original is fed from the feeding unit as a leading edge in the conveyance direction; and a rotation unit configured to cause an image formed on the first side of the original by the image forming unit and an image formed on the second side of the original by the image forming unit to rotate in accordance with a result of the determination of the second determination unit and a double-page spread setting for the original so as to align a top edge of the original and a top edge of an image formed by the image forming unit.

15. The image forming system according to claim 1, wherein the conveyance control unit is further configured to convey the original through the first main conveyance path and the first sub conveyance path an odd number of times and then discharge the original.

16. The image forming system according to claim 1, wherein a total distance of the second main conveyance path and the second sub conveyance path is shorter than a total distance of the first main conveyance path and the first sub conveyance path.

17. An image forming apparatus comprising:

a feeding unit configured to feed an original;

a reading unit configured to read the original fed from the feeding unit;

a first conveyance path having a reversal function that reverses the front and back of the original, and being configured to convey the original;

a second conveyance path having a reversal function that reverses the front and back of the original, and being configured to convey the original;

a connecting conveyance path that branches from the first conveyance path, joins the second conveyance path, and is configured to convey the original to the second conveyance path after the original is conveyed through at least a portion of a conveyance section in the first conveyance path;

an image forming unit configured to form an image on the original after the original is conveyed through at least a portion of a section of the second conveyance path;

a determination unit configured to determine a first side and a second side of the original based on a result of reading the original by the reading unit;

an acceptance unit configured to accept designation information that designates which of the first side and the second side of the original is an image formation side; and a conveyance control unit configured to control conveyance of the original in accordance with a result of the determination of the determination unit so that the first side becomes a side that faces the image forming unit if the first side of the original is designated as the image formation side or so that the second side becomes the side that faces the image forming unit if the second side of the original is designated as the image formation side.

18. The image forming apparatus according to claim 17, wherein the conveyance control unit is further configured to cause the first side of the original to face the image forming unit by causing the front and back of the original to be reversed in the first conveyance path if a total distance of the first conveyance path is shorter than a total distance of the second conveyance path.

19. The image forming apparatus according to claim 17, wherein the conveyance control unit is further configured to cause the first side of the original to face the image forming unit by causing the front and back of the original to be reversed in the second conveyance path if a total distance of the first conveyance path is longer than a total distance of the second conveyance path.

20. An image forming apparatus comprising:

a feeding unit configured to feed an original;

a reading unit configured to read the original fed from the feeding unit;

a main conveyance path configured to convey an original fed from the feeding unit;

an image forming unit configured to form an image on the original conveyed from the main conveyance path;

a sub conveyance path that branches from the main conveyance path on a downstream side from the image forming unit in a conveyance direction of the original, joins the main conveyance path on an upstream side from the image forming unit in the conveyance direction of the original, and has a reversing unit configured to cause the front and back of the original to be reversed;

a determination unit configured to determine a first side and a second side of the original based on a result of reading the original by the reading unit;

an acceptance unit configured to accept designation information that designates which of the first side and the second side of the original is to be an image formation side; and a conveyance control unit configured to control conveyance of the original in accordance with a result of the determination of the determination unit so that the first side becomes a side that faces the image forming unit if the first side of the original is designated as the image formation side or so that the second side becomes the side that faces the image forming unit if the second side of the original is designated as the image formation side.

* * * * *